US011009814B1

(12) United States Patent
Nishimura

(10) Patent No.: US 11,009,814 B1
(45) Date of Patent: May 18, 2021

(54) IMAGE FORMING APPARATUS

(71) Applicant: TOSHIBA TEC KABUSHIKI KAISHA, Tokyo (JP)

(72) Inventor: Yosuke Nishimura, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/951,013

(22) Filed: Nov. 18, 2020

(51) Int. Cl.
*G03G 15/00* (2006.01)
*G03G 15/16* (2006.01)
*G03G 21/16* (2006.01)

(52) U.S. Cl.
CPC ..... *G03G 15/1615* (2013.01); *G03G 15/161* (2013.01); *G03G 21/1638* (2013.01)

(58) Field of Classification Search
CPC ..... G03G 21/16; G03G 21/1623; G03G 21/1638; G03G 21/1633; G03G 21/168
USPC ..... 399/110, 121, 124
See application file for complete search history.

(56) References Cited

U.S. PATENT DOCUMENTS 9,910,400 B2 * 3/2018 Sato et al. ..... G03G 21/1623
10,386,781 B2 * 8/2019 Shima ..... G03G 21/1638

FOREIGN PATENT DOCUMENTS

JP 2012-198334 10/2012

* cited by examiner

*Primary Examiner* — William J Royer
(74) *Attorney, Agent, or Firm* — Amin, Turocy & Watson, LLP

(57) ABSTRACT

An image forming apparatus including: a transfer component including a transfer roller configured to transfer an image; a holding mechanism supported by a cover, configured to hold the transfer component; a lever rotatably between a first position and a second position, configured to pressurize the transfer component to press the transfer roller against an image carrier when the lever is at the first position; and an engagement portion supported by the cover, configured to engage with the lever to move the lever to the first position while the cover is closed, to engage with the lever to move the lever to the second position while the cover is opened, and to disengage from the lever to be separated from a space through which the lever is capable of passing when the lever is positioned at a third position between the first position and the second position.

20 Claims, 14 Drawing Sheets

IMAGE FORMING APPARATUS

FIELD

Embodiments described herein relate generally to an image forming apparatus.

BACKGROUND

An image forming apparatus that transfers an image formed on an intermediate transfer medium to a sheet using a transfer unit is known. In the image forming apparatus, an intermediate transfer medium is provided in an apparatus main body, and the transfer unit is provided in a cover unit that is openable and closable and provided in the apparatus main body. A pressurization mechanism that pressurizes the transfer unit against the intermediate transfer medium when the cover unit is closed is provided in the apparatus main body. The pressurization mechanism includes: a lever unit that is rotatable and supported in the apparatus main body; and a pressurization unit that is supported in a lever. An engagement portion that engages with the lever unit to rotate the lever is provided in the cover unit. When the cover unit is closed, the pressurization unit held in the lever is rotated and pressed against the pressurization unit, and the pressurization unit pressurizes the transfer unit against the intermediate transfer medium. When the cover unit is opened, the lever rotated by the engagement portion may collide against another portion of the engagement portion due to excessive force such that collision noise is generated.

DETAILED DESCRIPTION

Figure 1:
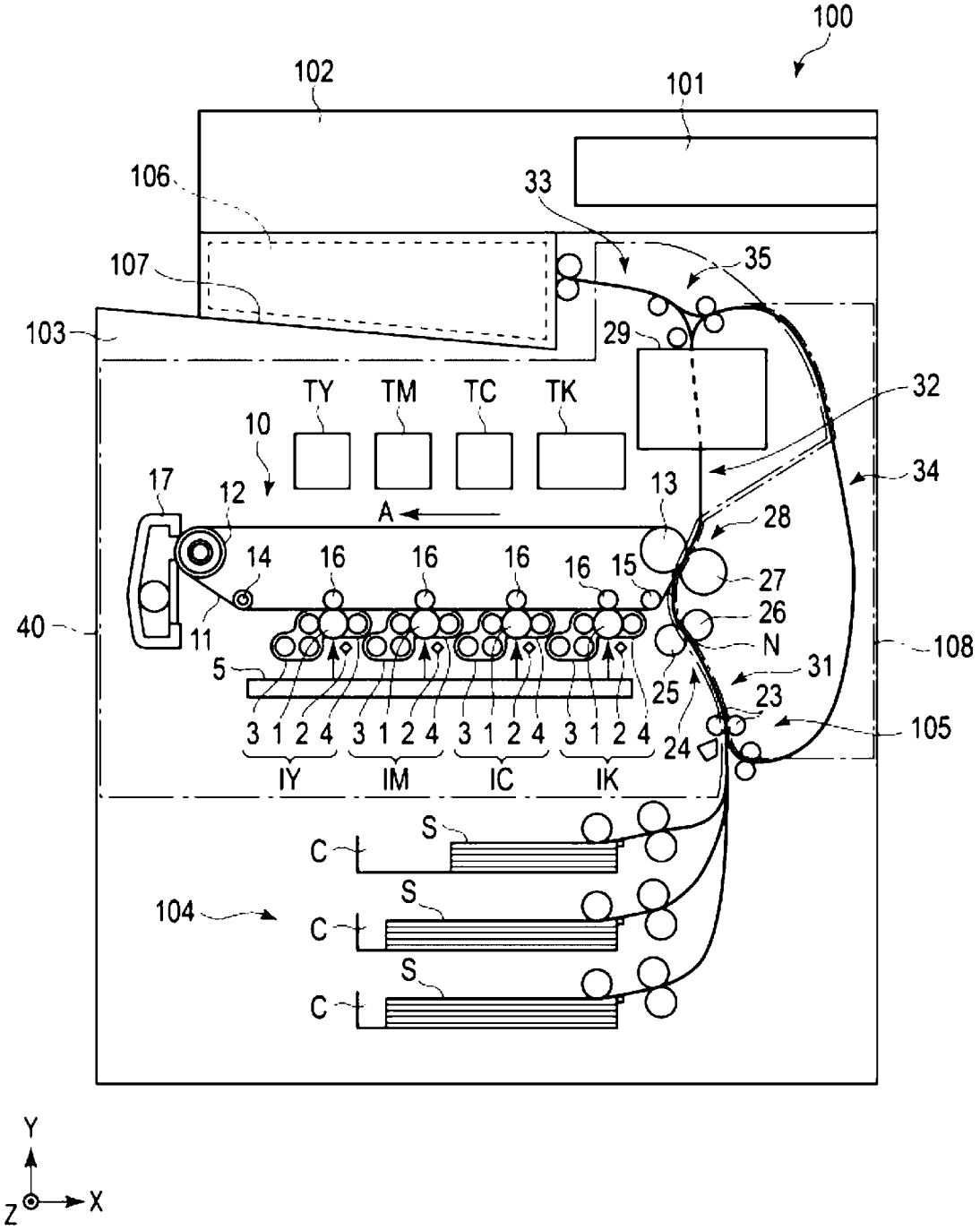
FIG. 1 is a diagram schematically illustrating an overall configuration of an image forming apparatus according to an embodiment.

In general, an image forming apparatus according to one embodiment includes: an intermediate transfer medium; an image forming unit configured to form an image on the intermediate transfer medium; a transfer unit including a transfer roller configured to transfer the image formed on the intermediate transfer medium to a sheet; an apparatus main body accommodating the intermediate transfer medium and the image forming unit; a cover unit configured to be openable and closeable, the cover unit being provided in the apparatus main body; a holding mechanism configured to hold the transfer unit such that the transfer unit is movable, the holding mechanism being provided in the cover unit; a pressurization mechanism configured to pressurize the transfer unit to press the transfer roller against the intermediate transfer medium, the pressurization mechanism being provided in the apparatus main body; and an engagement portion configured to engage with the pressurization mechanism to activate the pressurization mechanism, the engagement portion being provided in the cover unit. The pressurization mechanism includes a lever unit and a pressurization unit, the lever unit being rotatable between a first position and a second position and supported in the apparatus main body, and the pressurization unit being provided in the lever unit and abutting against the transfer unit to pressurize the transfer unit when the lever unit is moved to the first position.

In one aspect, the engagement portion engages with the lever unit to move the lever unit to the first position while the cover unit is closed relative to the apparatus main body, engages with the lever unit to move the lever unit to the second position while the cover unit is opened relative to the apparatus main body, and disengages from the lever unit to be separated from a space through which the lever unit is capable of passing when the lever unit is positioned at a third position between the first position and the second position.

In another aspect, the lever unit includes a first extension portion and a second extension portion that extend together in a radial direction of rotation of the lever unit and are distant from each other in an arc direction of rotation of the lever unit. The engagement portion includes a protrusion that engages with the first extension portion to move the lever unit to the first position while the cover unit is closed relative to the apparatus main body and engages with the second extension portion to move the lever unit to the second position while the cover unit is opened relative to the apparatus main body. The protrusion moves away from the lever unit as the cover unit opens relative to the apparatus main body, and disengages from the lever unit when the lever unit is positioned at a third position between the first position and the second position.

In addition, in still another aspect, the lever unit includes a first extension portion and a second extension portion that extend together in a radial direction of rotation of the lever unit and are distant from each other in an arc direction of rotation of the lever unit. The engagement portion includes a protrusion that engages with the first extension portion to move the lever unit to the first position while the cover unit is closed relative to the apparatus main body and engages with the second extension portion to move the lever unit to the second position while the cover unit is opened relative to the apparatus main body. The protrusion disengages from the lever unit when the lever unit is positioned at a third position between the first position and the second position. The engagement portion includes a recess portion that provides a space for preventing interference with the lever unit when the lever unit is positioned at the third position.

Hereinafter, an image forming apparatus according to an embodiment will be described with reference to the drawings. FIG. 1 is a diagram schematically illustrating an overall configuration of an image forming apparatus 100 according to the embodiment. In each of the following formulae, unless specified otherwise, the same or equivalent components are represented by the same reference numerals.

As illustrated in FIG. 1, the image forming apparatus 100 according to the embodiment includes a control panel 101, a scanner unit 102, a printer unit 103, a sheet supply unit 104, a conveying unit 105, a main control unit 106, a side cover unit 108, and an apparatus main body 40.

In order to describe a relative position relationship between the respective units in the image forming apparatus 100, an XYZ orthogonal coordinate system illustrated in FIG. 1 is set. A +X direction is a direction from the left to the right when seen from the front side (the front side of a plane in FIG. 1) of the image forming apparatus 100. A +Y direction is a vertically upward direction. A +Z direction is a direction from a rear surface to a front surface of the image forming apparatus 100.

The control panel 101 is operated by a user to activate the image forming apparatus 100.

The main control unit 106 controls the respective units of the image forming apparatus 100 in accordance with an operation of the control panel 101.

The scanner unit 102 reads image information of a copying object based on brightness and darkness of light. The scanner unit 102 outputs the read image information to the printer unit 103.

The printer unit 103 forms an image on a sheet S based on image information from the scanner unit 102 or an external apparatus.

The sheet supply unit 104 includes a plurality of paper feed cassettes C accommodating a plurality of sheets S. The sheet supply unit 104 picks up the sheets S required to form an image from the respective paper feed cassettes C one by one and supplies the picked sheet S to the conveying unit 105.

The conveying unit 105 includes a conveying roller 23 and a registration roller 24. The conveying unit 105 supplies the sheet S supplied from the sheet supply unit 104 to the printer unit 103.

The conveying roller 23 allows a tip of the sheet S in a conveying direction to abut against a nip N of the registration roller 24. The conveying roller 23 aligns a position of the tip of the sheet S in the conveying direction by bending the sheet S.

The registration roller 24 includes a first roller 25 positioned on the −X side and a second roller 26 positioned on the +X side across a conveyance path of the sheet S.

The first roller 25 is driven to rotate by a driving unit (not illustrated). The second roller 26 is movable and provided relative to the first roller 25. The second roller 26 abuts against the first roller 25 when the side cover unit 108 described below is closed, and is distant from the first roller 25 when the side cover unit 108 is opened.

The first roller 25 and the second roller 26 include gears (not illustrated) that are provided to be concentric with central axes thereof, respectively. The respective gears engage with each other when the second roller 26 abuts against the first roller 25. Due to the engagement between the gears, the second roller 26 receives a driving force from the first roller 25. As a result, the second roller 26 rotates in a direction opposite to the first roller 25 at the same line speed as that of the first roller 25.

The registration roller 24 aligns the tip of the sheet S conveyed from the conveying roller 23 in the nip N. Further, the registration roller 24 conveys the sheet S to the printer unit 103.

The printer unit 103 includes image forming units IY, IM, IC, and IK, toner cartridges TY, TM, TC, and TK, an exposure unit 5, an intermediate transfer unit 10, a secondary transfer roller 27, and a fixing unit 29.

The image forming units IY, IM, IC, and IK, the toner cartridges TY, TM, TC, and TK, the exposure unit 5, the intermediate transfer unit 10, and the fixing unit 29 are accommodated in the apparatus main body 40 described below. In addition, the secondary transfer roller 27 is provided in the side cover unit 108 described below.

The toner cartridges TY, TM, TC, and TK contain toners of yellow, magenta, cyan, and black, respectively. The toners of the toner cartridges TY, TM, TC, and TK are supplied to the image forming units IY, IM, IC, and IK, respectively, through toner replenishment tubes (not illustrated).

The image forming units IY, IM, IC, and IK form images (toner images) using different toners supplied from the toner cartridges TY, TM, TC, and TK, respectively. That is, the image forming units IY, IM, IC, and IK form toner images of yellow, magenta, cyan, and black.

The image forming units IY, IM, IC, and IK have the same configuration except that the toners to be used are different from each other. Each of the image forming units IY, IM, IC, and IK includes a photoconductive drum 1, a charging unit 2, a developing unit 3, a cleaner 4, and a charge eraser.

The photoconductive drum 1 is an image carrier on which a latent image is formed. The photoconductive drum 1 includes a photoreceptor on an outer circumferential surface. The charging unit 2 uniformly charges a surface of the photoconductive drum 1. The photoconductive drum 1 that is uniformly charged is selectively irradiated with light from the exposure unit 5 to form an electrostatic latent image. The developing unit 3 forms a toner image by developing the electrostatic latent image formed on the photoconductive drum 1 with the toner. The formed toner image is primarily transferred to an intermediate transfer belt 11 of the intermediate transfer unit 10 described below. The cleaner 4 removes the toner attached to the photoconductive drum 1 after the primary transfer.

Image information corresponding to yellow, magenta, cyan, and black are supplied to the exposure unit 5. The exposure unit 5 selectively irradiates the photoconductive drums 1 of the image forming units IY, IM, IC, and IK with light in accordance with the supplied image information. The electrostatic latent images corresponding to yellow, magenta, cyan, and black are formed on the photoconductive drums 1 of the image forming units IY, IM, IC, and IK, respectively. The exposure unit 5 includes a light source such as a laser or an LED. From another viewpoint, it may be said that the image forming units IY, IM, IC, and IK share the exposure unit 5.

The intermediate transfer unit 10 includes the intermediate transfer belt 11, a transfer belt roller 12, and support rollers 13, 14, and 15.

The intermediate transfer belt 11 is an endless belt and is an intermediate transfer medium on which the toner images are formed by the image forming units IY, IM, IC, and IK.

The transfer belt roller 12 and the support rollers 13, 14, and 15 support the intermediate transfer belt 11 by applying a tensile force to the intermediate transfer belt 11. The transfer belt roller 12 rotates such that the intermediate transfer belt 11 revolves in a direction of an arrow A. The support rollers 13, 14, and 15 drive to rotate by the revolution of the intermediate transfer belt 11.

The image forming units IY, IM, IC, and IK are provided in this order in the revolving direction A of the intermediate transfer belt 11.

The intermediate transfer unit 10 further includes four primary transfer rollers 16. The primary transfer rollers 16 face the image forming units IY, IM, IC, and IK through the intermediate transfer belt 11. A transfer bias is applied to the primary transfer roller 16 in synchronization with the photoconductive drum 1. As a result, the primary transfer roller 16 primarily transfers the toner images formed on the photoconductive drums 1 of the image forming units IY, IM, IC, and IK to the intermediate transfer belt 11. The formation of the toner images by the image forming units IY, IM, IC, and IK and the movement of the intermediate transfer belt 11 are synchronized with each other. As a result, the toner images formed by the image forming units IY, IM, IC, and IK are superimposed and transferred to the intermediate transfer belt 11.

In addition, the intermediate transfer unit 10 includes a cleaner 17. The cleaner 17 removes toner attached to the intermediate transfer belt 11. For example, the cleaner 17 includes a plate-shaped cleaning blade. The cleaning blade faces the transfer belt roller 12 through the intermediate transfer belt 11.

The secondary transfer roller 27 and the support roller 13 form a secondary transfer unit 28 that transfers the toner image primarily transferred to the intermediate transfer belt 11 to the sheet S. The secondary transfer roller 27 faces the support roller 13 through the intermediate transfer belt 11. The secondary transfer roller 27 is in contact with the intermediate transfer belt 11 and is driven to rotate by the revolution of the intermediate transfer belt 11. A transfer bias is applied between the secondary transfer roller 27 and the support roller 13. As a result, the secondary transfer roller 27 transfers the toner image on the intermediate transfer belt 11 to the sheet S.

The fixing unit 29 applies heat and pressure to the sheet S to which the toner image is secondarily transferred. The fixing unit 29 fixes the toner image secondarily transferred to the sheet S using the heat and pressure.

In a region from the registration roller 24 to the secondary transfer unit 28, a conveyance path 31 that conveys the sheet S from the bottom to the top is provided. In addition, in a region from the secondary transfer unit 28 to the fixing unit 29, a conveyance path 32 that conveys the sheet S from the bottom to the top is provided.

Above the fixing unit 29, a conveyance path 33 that discharges the sheet S in the −X direction is formed. Below an exit of the conveyance path 33 in the −X direction, a discharge tray 107 on which the sheet S discharged from the conveyance path 33 is placed is provided.

Above the fixing unit 29, a conveying direction switching unit 35 that switches a conveying direction of the sheet S is provided.

In the printer unit 103 on the +X side further than the conveyance paths 31 and 32, a conveyance path 34 that conveys the sheet S from the conveying direction switching unit 35 to the registration roller 24 is provided. For example, when duplex printing is executed, the conveyance path 34 is used to invert the sheet S having a surface on which an image is formed and to convey the inverted sheet S to the registration roller 24.

Each of the conveyance paths 31, 32, 33, and 34 includes conveyance guide portions that face each other with respect to the sheet S and a conveying roller that is optionally provided.

The printer unit 103 further includes the side cover unit 108. The side cover unit 108 is provided at an end portion of the printer unit 103 in the +X direction. A surface of the side cover unit 108 in the +X direction forms a side surface of the printer unit 103 in the +X direction.

The side cover unit 108 includes apart of the conveyance paths 31, 32, 33, and 34, the secondary transfer roller 27, and the second roller 26 of the registration roller 24. Specifically, the side cover unit 108 includes conveyance guide portions on the +X side in the conveyance paths 31 and 32.

The side cover unit 108 is openable and closable and provided relative to the apparatus main body 40 described below of the printer unit 103. The side cover unit 108 is rotatable in a predetermined angle range around an opening and closing shaft parallel to a Z-axis. The side cover unit 108 is opened and closed by user operating an operation unit such as a knob or a lever (not illustrated).

When the conveyance guide portions on the +X side in the conveyance paths 31 and 32 rotate in the +X direction together with the side cover unit 108, conveyance guide portions on the −X side in the conveyance paths 31 and 32 are exposed. Therefore, when the sheet S is jammed in the conveyance paths 31 and 32, a jamming process is executed by opening the side cover unit 108.

Figure 2:
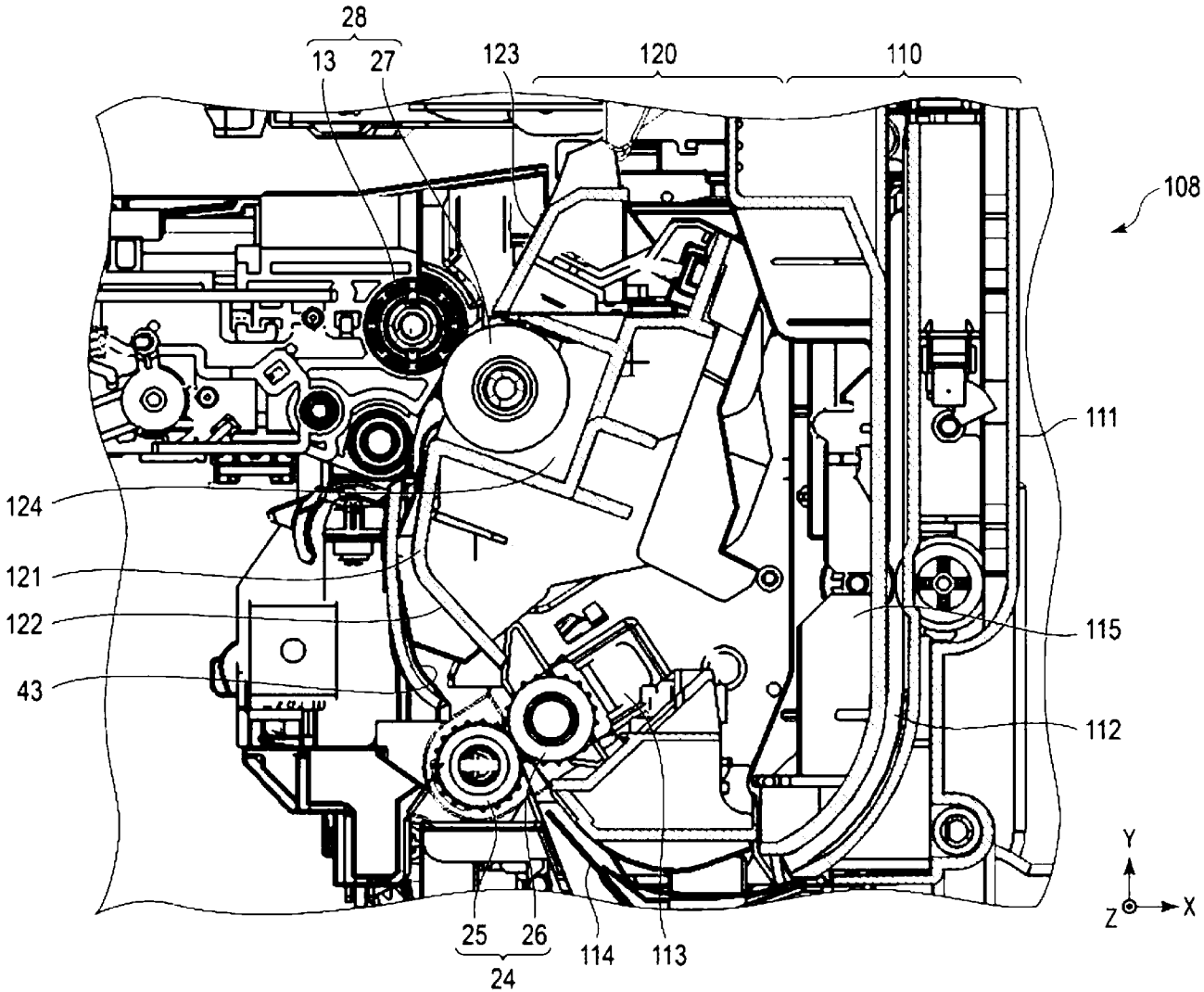
FIG. 2 is a cross-sectional view illustrating a side cover unit in the image forming apparatus according to the embodiment.
Figure 3:
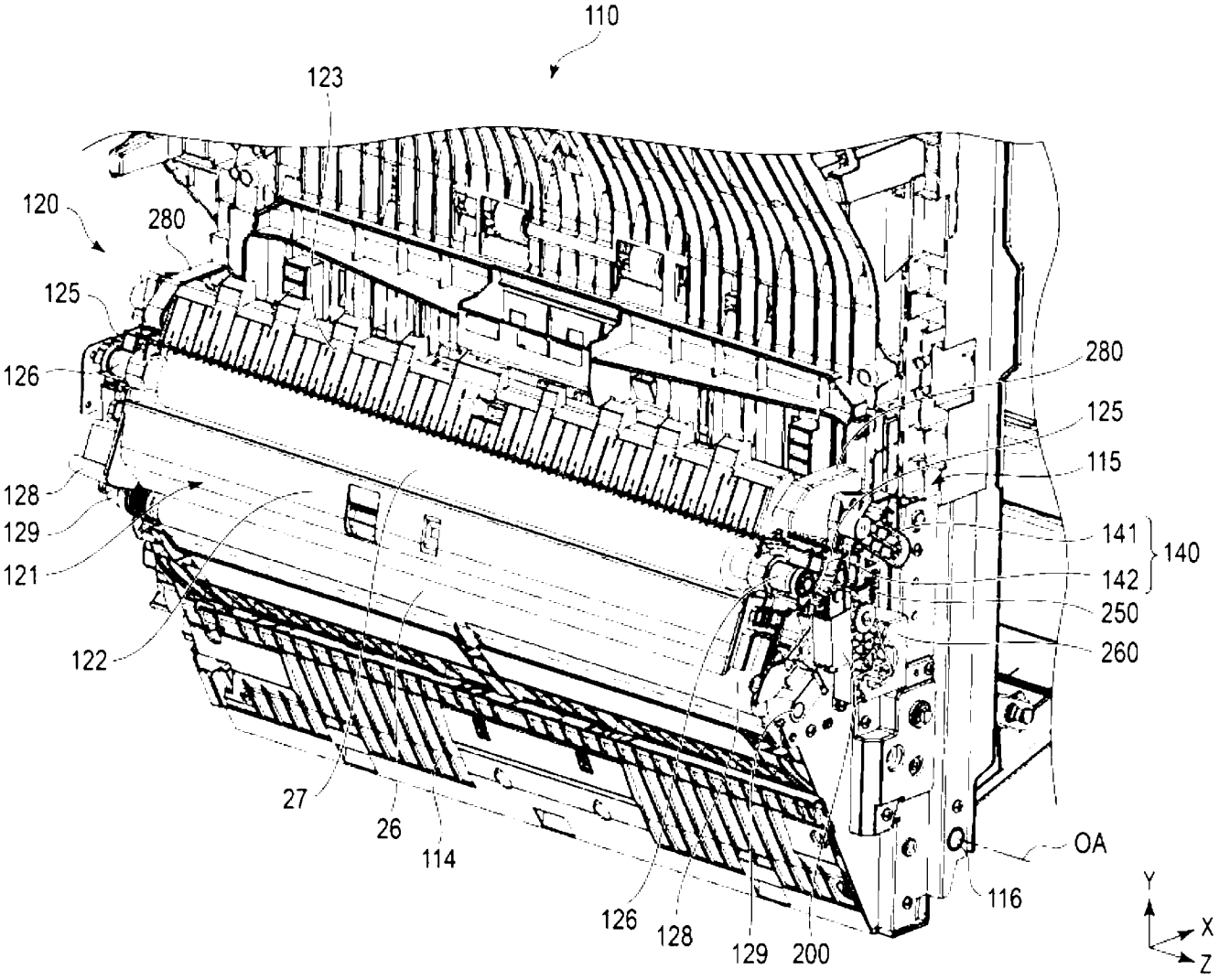
FIG. 3 is a perspective view illustrating the side cover unit.
Figure 4:
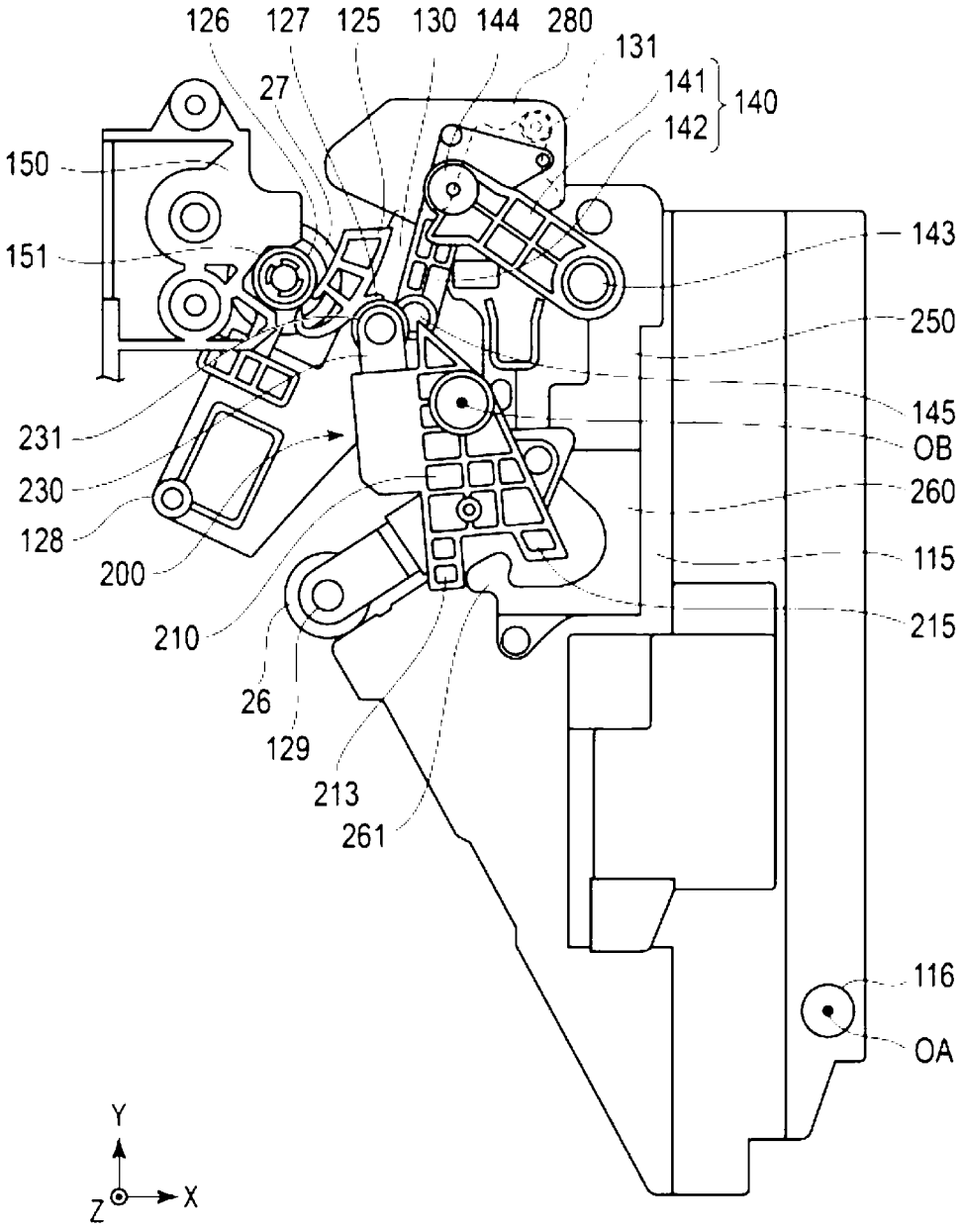
FIG. 4 is a side view illustrating the side cover unit.

Next, the details of the side cover unit 108 will be described with reference to FIGS. 2 to 4. FIG. 2 is a cross-sectional view illustrating the side cover unit 108 in the image forming apparatus 100 according to the embodiment. FIG. 3 is a perspective view illustrating the side cover unit 108 in the image forming apparatus 100 according to the embodiment. FIG. 4 is a side view illustrating the side cover unit 108 in the image forming apparatus 100 according to the embodiment.

FIG. 2 illustrates the side cover unit 108 in a closed state. Hereinafter, unless specified otherwise, the configuration of the side cover unit 108 will be described based on a posture of the side cover unit 108 in the closed state.

The side cover unit 108 includes a cover unit main body 110 and a transfer roller unit 120.

The cover unit main body 110 includes an external portion 111, a conveying unit 112, a registration roller holding unit 113, and a transfer roller unit holding unit 115.

The external portion 111 is exposed to the side surface of the printer unit 103 in the +X direction. The external portion 111 may include a jamming process cover unit, a manual unit, or the like that opens the conveyance path 33 in the conveying unit 112.

The conveying unit 112 forms at least a part of the conveyance path 33. The conveying unit 112 is provided inside of the external portion 111, that is, on the −X side.

The registration roller holding unit 113 holds the second roller 26 such that the second roller 26 can pressurize the first roller 25 disposed on the apparatus main body 40 side described below.

The cover unit main body 110 includes a conveyance guide portion 114 that forms a part of the conveyance path 31 from the conveying roller 23 (refer to FIG. 1) to the registration roller 24 in the vicinity of the registration roller holding unit 113.

The transfer roller unit holding unit 115 holds the transfer roller unit 120 described below such that the transfer roller unit 120 is movable.

As illustrated in FIG. 3, the cover unit main body 110 includes a pair of round hole portions 116 at opposite side portions of a lower end portion along the Z-axis. That is, the cover unit main body 110 includes one round hole portion 116 at each of a side portion on the −Z side and a side portion on the +Z side in the lower end portion. The pair of round hole portions 116 extend concentrically to be parallel to the Z-axis.

A rotation support shaft 44 (refer to FIG. 5) described below provided in the apparatus main body 40 of the printer unit 103 is inserted into the round hole portion 116. As a result, the cover unit main body 110 is rotatable around an opening and closing shaft OA and attached to the apparatus main body 40.

In addition, the cover unit main body 110 includes a pair of engagement units 250. The pair of engagement units 250 are fixed to opposite side surface portions of the cover unit main body 110 along the Z-axis, respectively. The pair of engagement units 250 have plane-symmetrical shapes and are disposed to be plane symmetrical with respect to an XY plane that bisects the apparatus main body 40.

The engagement unit 250 includes an engagement portion 260 and an engagement holder 280. Along with an opening and closing operation of the side cover unit 108, the engagement portion 260 engages with a pressurization mechanism 200 described below to activate the pressurization mechanism 200. The details of the engagement unit 250 will be described after describing the pressurization mechanism 200. In addition, the engagement holder 280 engages with an engagement portion 130 provided in the transfer roller unit 120 and two-dimensionally guides the transfer roller unit 120.

As illustrated in FIG. 2, the transfer roller unit 120 includes a secondary transfer roller 27 and a unit main body 121.

The unit main body 121 holds the secondary transfer roller 27 such that the secondary transfer roller 27 is rotatable. The unit main body 121 is movable relative to the external portion 111 and held by the transfer roller unit holding unit 115.

The unit main body 121 includes a first conveyance guide portion 122 at a lower portion of a side surface on the −X side and includes a second conveyance guide portion 123 at an upper portion of the side surface on the −X side.

When the side cover unit 108 is closed, the first conveyance guide portion 122 faces a conveyance guide portion 43 provided in the apparatus main body 40 of the printer unit 103. The first conveyance guide portion 122 and the conveyance guide portion 43 form the conveyance path 31 (refer to FIG. 1).

When the side cover unit 108 is closed, the second conveyance guide portion 123 faces a conveyance guide portion (not illustrated) provided in the apparatus main body 40 of the printer unit 103. The second conveyance guide portion 123 and the conveyance guide portion (not illustrated) form the conveyance path 32 (refer to FIG. 1).

In addition, the unit main body 121 includes a secondary transfer roller holding unit 124 provided between the first conveyance guide portion 122 and the second conveyance guide portion 123. The secondary transfer roller holding unit 124 is a recess portion accommodating the secondary transfer roller 27.

As illustrated in FIG. 3, the transfer roller unit 120 includes a pair of bearing holders 125, a pair of engagement shafts 128, and a pair of bearings 129 at opposite side surface portions along the Z-axis, respectively. The pair of bearing holders 125, the pair of engagement shafts 128, and the pair of bearings 129 have plane-symmetrical shapes and are disposed to be plane symmetrical with respect to an XY plane that bisects the apparatus main body 40, respectively.

The bearing holder 125, the engagement shaft 128, and the bearing 129 are provided to position the transfer roller unit 120 in the printer unit 103.

Each of the bearing holders 125 supports a bearing 126. The bearing 126 supports the secondary transfer roller 27 such that the secondary transfer roller 27 is rotatable. When the side cover unit 108 is closed, the bearing 126 engages with an engagement member 150 described below in the printer unit 103.

In addition, as illustrated in FIG. 4, the bearing holder 125 includes a pressurization unit abutting portion 127. The pressurization unit abutting portion 127 is a recess portion that is upwardly recessed. When the side cover unit 108 is closed, the pressurization unit abutting portion 127 abuts against a pressurization roller 231 described below and receives a pressurization force from the pressurization roller 231.

The engagement shaft 128 extends to be parallel to the bearing 126 in a region below the bearing 126. When the side cover unit 108 is closed, the engagement shaft 128 engages with the engagement member 150 described below in the printer unit 103.

The bearing 129 supports the second roller 26 such that the second roller 26 is rotatable. When the side cover unit 108 is closed, the bearing 129 engages with a registration roller support unit 160 described below in the printer unit 103.

The unit main body 121 including the bearing holder 125 and the bearing 126 configures a support body that supports the secondary transfer roller 27.

As illustrated in FIG. 3, the cover unit main body 110 and the transfer roller unit 120 are movable and connected by a pair of link mechanisms 140 at opposite end portions along the Z-axis. FIG. 3 illustrates only one link mechanism 140. The link mechanism 140 is illustrated in a folded state. In this case, the transfer roller unit 120 is closest to the transfer roller unit holding unit 115, and the entirety of the transfer roller unit 120 is held by the transfer roller unit holding unit 115.

Here, the link mechanism 140 on the front side, that is, on the +Z side will be described as a representative example with reference to FIG. 4. The link mechanism 140 includes a first link 141 and a second link 142.

An end portion of the first link 141 on the right side, that is, the +X side is rotatable and connected to a side surface of the transfer roller unit holding unit 115 on the +Z side through a rotation support shaft 143 extending along the Z-axis.

An end portion of the first link 141 on the left side, that is, the −X side is rotatable and connected to an end portion of the second link 142 on the right side, that is, the +X side through a rotation joint 144.

An end portion of the second link 142 on the left side, that is, the −X side is rotatable and connected to a side surface of the unit main body 121 on the +Z side through a rotation support shaft 145 extending along the Z-axis.

In addition, the transfer roller unit 120 illustrated in FIG. 3 includes the engagement portion 130 (refer to FIG. 4) that engages with the engagement holder 280 at opposite side portions along the Z-axis. The engagement portion 130 includes an engagement shaft 131 that protrudes to the outside along the Z-axis. The engagement shaft 131 is inserted into a recess portion of the engagement holder 280. The recess portion of the engagement holder 280 two-dimensionally guides the engagement shaft 131 in an XY plane. As a result, the transfer roller unit 120 is movable in a range of the recess portion of the engagement holder 280 and in a movable range of the link mechanism 140 and held by the transfer roller unit holding unit 115.

Figure 5:
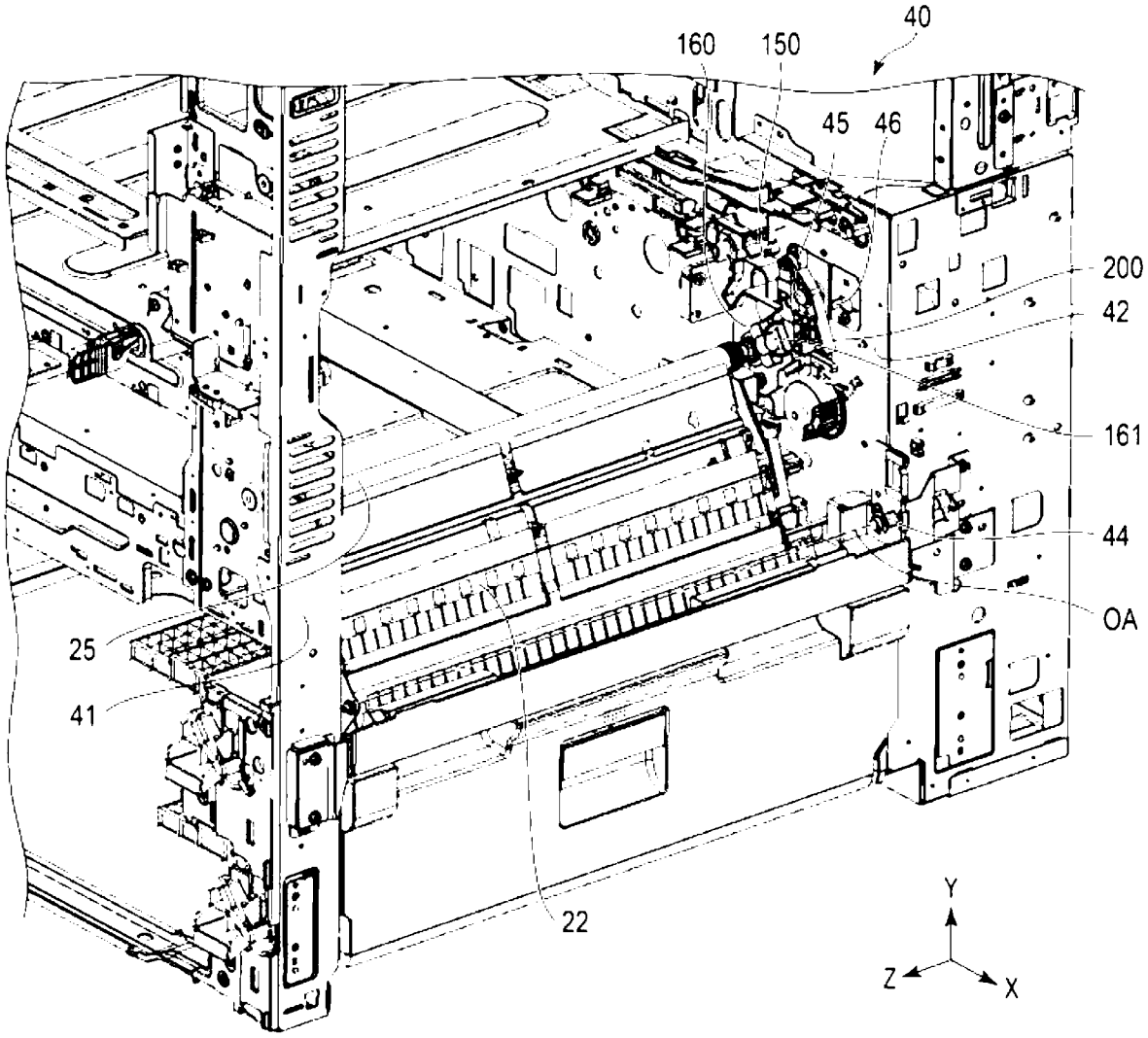
FIG. 5 is a perspective view illustrating a rear inner portion of an apparatus main body of a printer unit in the image forming apparatus according to the embodiment.
Figure 6:
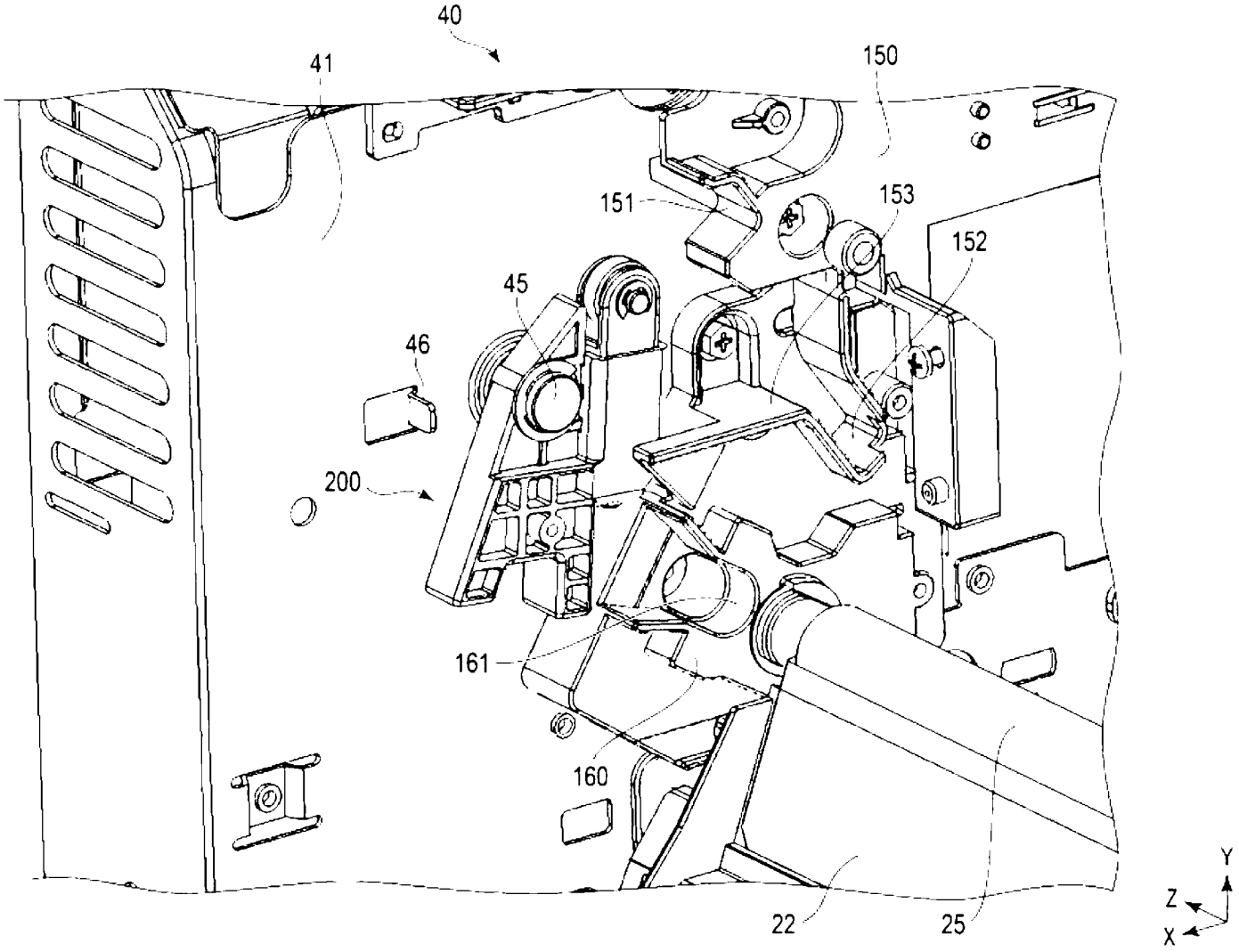
FIG. 6 is a perspective view illustrating a front inner portion of the apparatus main body of the printer unit.

Next, a relationship between the apparatus main body 40 of the printer unit 103 and the cover unit main body 110 will be described with reference to FIGS. 5 and 6. FIG. 5 is a perspective view illustrating a rear inner portion of an apparatus main body 40 of the printer unit 103 in the image forming apparatus 100 according to the embodiment. FIG. 6 is a perspective view illustrating a front inner portion of the apparatus main body 40 of the printer unit 103 in the image forming apparatus 100 according to the embodiment.

As illustrated in FIG. 5, the apparatus main body 40 of the printer unit 103 includes a front plate 41 and a rear plate 42. The front plate 41 and the rear plate 42 are provided in a portion of the printer unit 103 on the front side, that is, the +Z side and in a portion of the printer unit 103 on the rear side, that is, the −Z side, respectively.

The front plate 41 and the rear plate 42 are connected to each other through various span materials extending along the Z-axis. The distance between the front plate 41 and the rear plate 42 is substantially equal to the width of the cover unit main body 110, that is, the dimension thereof along the Z-axis.

For example, the conveyance guide portion 22 of the conveying unit 105 (refer to FIG. 1) on the apparatus main body 40 side extends between the front plate 41 and a lower portion of the rear plate 42. In the vicinity of an upper portion of the conveyance guide portion 22, the first roller 25 extends along the Z-axis.

As illustrated in FIG. 5, the rear plate 42 includes the rotation support shaft 44 that is provided on a surface on the +Z side and protrudes in the +Z direction. Although not illustrated in FIG. 5, the front plate 41 includes the rotation support shaft 44 that is provided on a surface on the −Z side and protrudes in the −Z direction. The rotation support shaft 44 of the rear plate 42 and the rotation support shaft 44 of the front plate 41 are concentrically disposed.

The rotation support shaft 44 of the rear plate 42 and the rotation support shaft 44 of the front plate 41 are inserted into the pair of round hole portions 116 that are formed at opposite side portions of a lower end portion of the cover unit main body 110. As a result, the cover unit main body 110 is rotatable around the opening and closing shaft OA and supported by the rotation support shaft 44 in a region between the front plate 41 and the rear plate 42.

As illustrated in FIG. 5, the rear plate 42 includes the engagement member 150, the registration roller support unit 160, and the pressurization mechanism 200 on a surface on the +Z side.

As illustrated in FIG. 6, the front plate 41 includes the engagement member 150, the registration roller support unit 160, and the pressurization mechanism 200 on a surface on the −Z side.

The engagement member 150, the registration roller support unit 160, and the pressurization mechanism 200 of the rear plate 42 and the engagement member 150, the registration roller support unit 160, and the pressurization mechanism 200 of the front plate 41 have plane-symmetrical shapes and are disposed to be plane symmetrical with respect to an XY plane that bisects the apparatus main body 40, respectively. That is, the pair of engagement members 150 and the pair of pressurization mechanisms 200 are plane-symmetrical structures, respectively.

When the side cover unit 108 is closed, the pair of engagement members 150 engage with opposite end portions of the transfer roller unit 120 in the side cover unit 108 to determine the transfer roller unit 120.

The pair of registration roller support units 160 support the first roller 25 such that the first roller 25 is rotatable. In addition, when the side cover unit 108 is closed, the registration roller support unit 160 includes an engagement groove 161 that engages with the second roller 26.

When the side cover unit 108 is closed, the pair of pressurization mechanisms 200 pressurize the opposite end portions of the transfer roller unit 120 to press the transfer roller unit 120 against the engagement member 150. As a result, the secondary transfer roller 27 of the transfer roller unit 120 presses the intermediate transfer belt 11 at a position of the support roller 13. As described below, the pressurization by the pressurization mechanism 200 is released when the side cover unit 108 is opened.

The engagement member 150 includes a first engagement groove 151 that engages with the bearing 126, a second engagement groove 152 that engages with the engagement shaft 128, and a support unit 153 that supports the engagement shaft 128.

The engagement member 150 is formed of, for example, a molded article of a resin having excellent sliding performance for the bearing 126, the engagement shaft 128, and the bearing 129. The engagement member 150 is fixed to the front plate 41 and the rear plate 42 through, for example, a screw or the like.

The pressurization mechanism 200 of the front plate 41 is rotatable around the Z-axis and supported by a rotation support shaft 45 that protrudes in the −Z direction from a surface of the front plate 41 on the −Z side.

As illustrated in FIG. 5, the pressurization mechanism 200 of the rear plate 42 is rotatable around the Z-axis and supported by the rotation support shaft 45 that protrudes in the +Z direction from a surface of the rear plate 42 on the +Z side.

The rotation support shaft 45 of the front plate 41 and the rotation support shaft 45 of the rear plate 42 are concentrically disposed. As a result, the pressurization mechanism 200 of the front plate 41 and the pressurization mechanism 200 of the rear plate 42 are rotatable around a common rotation shaft OB and supported. The rotation shaft OB of the pressurization mechanism 200 is parallel to the opening and closing shaft OA of the cover unit main body 110.

In addition, the pressurization mechanism 200 is rotatable and supported between a first position and a second position. The first position and the second position are limit positions where the pressurization mechanism 200 is rotatable.

The first position is a position where the pressurization mechanism 200 pressurizes the transfer roller unit 120 when the side cover unit 108 is closed.

As illustrated in FIG. 6, the front plate 41 includes a rotation stopper 46 that restricts a rotation range of the pressurization mechanism 200. In addition, as illustrated in FIG. 5, the rear plate 42 includes the rotation stopper 46 that restricts a rotation range of the pressurization mechanism 200. The rotation stopper 46 of the front plate 41 and the rotation stopper 46 of the rear plate 42 are positioned to be plane-symmetrical with respect to the XY plane.

In FIG. 6, the clockwise rotation of the pressurization mechanism 200 is restricted when the pressurization mechanism 200 abuts against the rotation stopper 46. The second position is a position where the pressurization mechanism 200 abuts against the rotation stopper 46.

Figure 7:
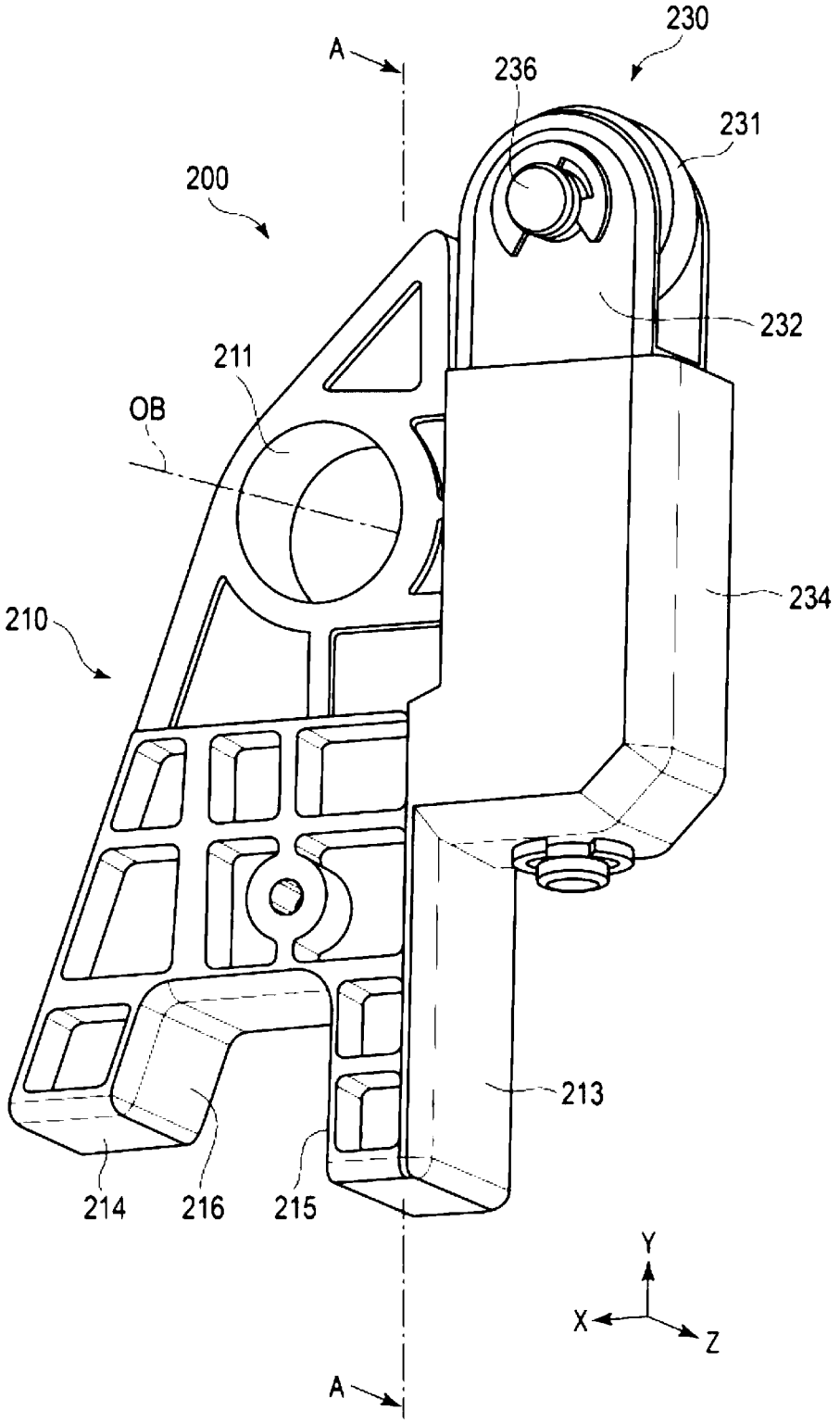
FIG. 7 is a perspective view illustrating a pressurization mechanism.
Figure 8:
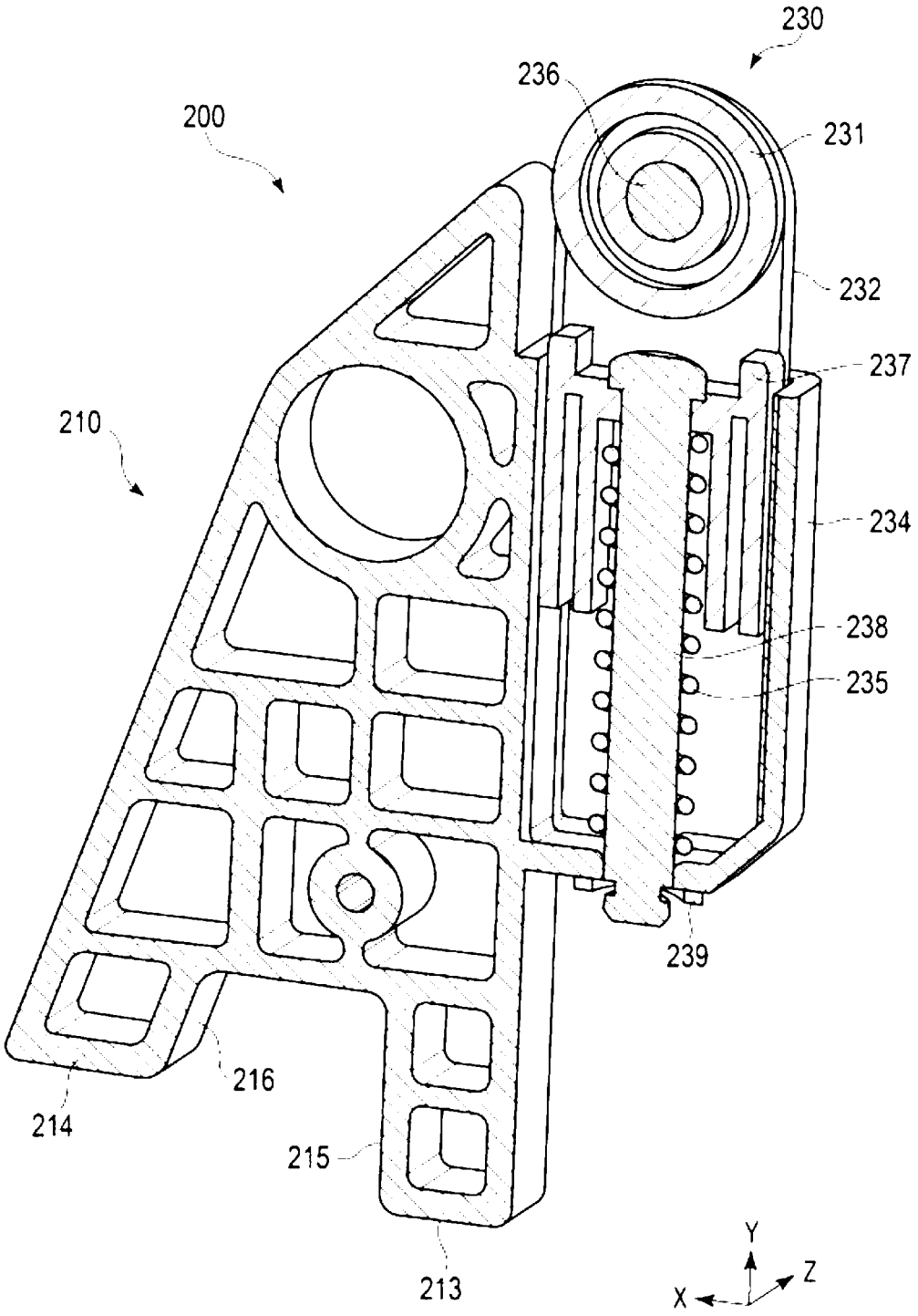
FIG. 8 is a cross-sectional view illustrating the pressurization mechanism taken along line A-A illustrated in FIG. 7.

Hereinafter, the pressurization mechanism 200 will be described in detail with reference to FIGS. 7 and 8. FIG. 7 is a perspective view illustrating the pressurization mechanism 200 in the image forming apparatus 100 according to the embodiment. FIG. 8 is a cross-sectional view illustrating the pressurization mechanism 200 taken along line A-A illustrated in FIG. 7.

As illustrated in FIGS. 7 and 8, the pressurization mechanism 200 includes a lever unit 210 that is rotatable and supported by the rotation support shaft 45 (refer to FIG. 6), and a pressurization unit 230 that is held by the lever unit 210.

The lever unit 210 includes a hole portion 211 that is rotatable and fitted to the rotation support shaft 45. By the rotation support shaft 45 being fitted to the hole portion 211, the lever unit 210 is rotatable and supported between the first position and the second position.

The lever unit 210 includes a first extension portion 213 and a second extension portion 214 that extend in a radial direction of rotation of the lever unit 210. The first extension portion 213 and the second extension portion 214 are distant from each other in an arc direction of rotation of the lever unit 210. Although not limited thereto, edges of lower end portions of the first extension portion 213 and the second extension portion 214 are rounded in a cylindrical shape or an elliptic cylindrical shape.

The first extension portion 213 includes a pressurization force receiving portion 215 that receives a pressurization force to move the lever unit 210 to the first position. The second extension portion 214 includes a depressurization force receiving portion 216 that receives a depressurization force to move the lever unit 210 to the second position. The pressurization force receiving portion 215 and the depressurization force receiving portion 216 face each other.

The first extension portion 213 is positioned inside of the apparatus main body 40, that is, on the −X side further than the second extension portion 214. That is, the second extension portion 214 is positioned closer to the side cover unit 108 than the first extension portion 213. Accordingly, the pressurization force receiving portion 215 is positioned inside of the apparatus main body 40, that is, on the −X side further than the depressurization force receiving portion 216.

As illustrated in FIGS. 7 and 8, the pressurization unit 230 includes the pressurization roller 231, a pressurization roller holder 232, and a holder guide unit 234. In addition, as illustrated in FIG. 8, the pressurization unit 230 includes a pressurization spring 235 and a guide shaft 238.

The pressurization roller 231 is rotatable and supported by a rotation support shaft 236 extending along the Z-axis.

The pressurization roller holder 232 supports the rotation support shaft 236 in an upper region. The pressurization roller holder 232 includes a spring accommodation portion 237 in a lower region. The spring accommodation portion 237 is movable along the Y-axis and accommodated in the holder guide unit 234.

The holder guide unit 234 is a bottomed tubular portion with an open upper end. For example, the holder guide unit 234 is formed to be integrated with the lever unit 210. The holder guide unit 234 may be configured with a structure separate from the lever unit 210 and fixed to the lever unit 210.

The pressurization spring 235 is disposed between the holder guide unit 234 and the spring accommodation portion 237. The pressurization spring 235 provides an elastic force that biases the pressurization roller holder 232 upward with respect to the holder guide unit 234.

The guide shaft 238 penetrates the holder guide unit 234 and the spring accommodation portion 237 and extends along the Y-axis. That is, the holder guide unit 234 and the spring accommodation portion 237 have a through hole that the guide shaft 238 penetrates. The pressurization spring 235 is configured with a compression coil spring, and the guide shaft 238 extends to the inside of the coil spring.

The guide shaft 238 includes an upper end portion having a larger diameter than the through hole of the spring accommodation portion 237. A lower end portion of the guide shaft 238 protrudes through the through hole of the holder guide unit 234, and a retainer portion 239 is attached thereto through a C-ring or the like. As a result, the guide shaft 238 restricts a movable range of the pressurization roller holder 232 relative to the holder guide unit 234.

When the side cover unit 108 is closed, the pressurization roller 231 abuts against the pressurization unit abutting portion 127 (refer to FIG. 4) from below immediately before the side cover unit 108 is closed. When the side cover unit 108 is further closed, a free movement of the pressurization roller 231 is restricted by the pressurization unit abutting portion 127. Therefore, the pressurization spring 235 is compressed. As a result, the pressurization spring 235 pressurizes the pressurization roller 231 against the pressurization unit abutting portion 127 from below.

Figure 9:
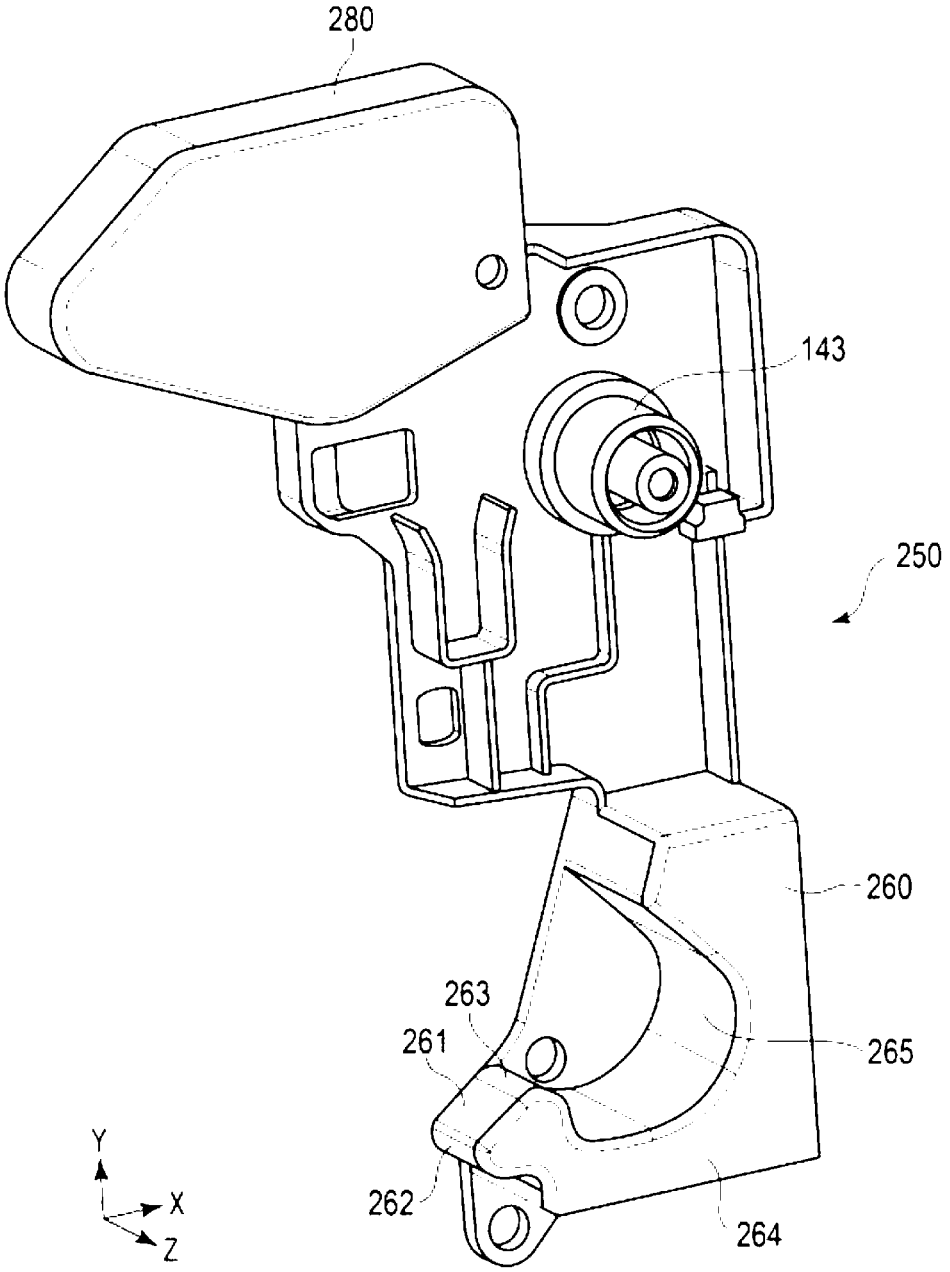
FIG. 9 is a perspective view illustrating an engagement unit in the image forming apparatus according to the embodiment.

Next, the details of the engagement unit 250 will be described with reference to FIG. 9. FIG. 9 is a perspective view illustrating the engagement unit 250 in the image forming apparatus 100 according to the embodiment.

As illustrated in FIG. 9, the engagement unit 250 includes the engagement holder 280 that engages with the engagement portion 130 provided in the transfer roller unit 120 in an upper portion, and includes the engagement portion 260 that engages with the pressurization mechanism 200 provided in the apparatus main body 40 in a lower portion. In addition, the engagement unit 250 includes the rotation support shaft 143 that is provided between the engagement holder 280 and the engagement portion 260 and is connected to an end portion of the first link 141 of the link mechanism 140.

When the side cover unit 108 is closed, the engagement portion 260 engages with the lever unit 210 of the pressurization mechanism 200 to move the lever unit 210 to the first position. In addition, when the side cover unit 108 is opened, the engagement portion 260 engages with the lever unit 210 to move the lever unit 210 to the second position. Further, the engagement portion 260 disengages from the lever unit 210 to be separated from a space through which the lever unit 210 is capable of passing when the lever unit 210 is positioned at a third position between the first position and the second position.

The engagement portion 260 includes a lower end portion 264 that extends to the inside of the apparatus main body 40, that is, the −X side, and includes a protrusion 261 at a tip portion of the lower end portion 264. The protrusion 261 protrudes obliquely upward to the inside of the apparatus main body 40, that is, the −X side. Therefore, the engagement portion 260 includes a recess portion 265 that is open to the outside of the protrusion 261, that is, the +Z side.

The protrusion 261 includes a pressurization force applying portion 262 and a depressurization force applying portion 263. The pressurization force applying portion 262 and the depressurization force applying portion 263 are positioned opposite to each other in the protrusion 261. Specifically, the pressurization force applying portion 262 is positioned on the left side of the protrusion 261, that is, the −X side, and the depressurization force applying portion 263 is positioned on the right side of the protrusion 261, that is, the +X side. Although not limited thereto, the pressurization force applying portion 262 and the depressurization force applying portion 263 are rounded in a cylindrical shape or an elliptic cylindrical shape.

Next, an operation of the image forming apparatus 100 will be described. First, an image forming operation of the image forming apparatus 100 will be simply described.

In the image forming apparatus 100 illustrated in FIG. 1, image formation starts based on an operation of the control panel 101 or an external signal. Image information is read from a copying object by the scanner unit 102 and is transmitted to the printer unit 103. Alternatively, image information is transmitted to the printer unit 103 from an external apparatus. The printer unit 103 supplies the sheet S from the sheet supply unit 104 to the registration roller 24. The sheet S supplied from the sheet supply unit 104 is selected by the main control unit 106 based on an operation of the control panel 101 or an external signal.

When an operation input for image formation is received from the control panel 101, the main control unit 106 executes a control to supply the sheet S from the paper feed cassette and to start image formation.

The image forming units IY, IM, IC, and IK form toner images on the intermediate transfer belt 11 based on image information corresponding to the respective colors.

Specifically, the photoconductive drum 1 is uniformly charged by the charging unit 2. The exposure unit 5 forms an electrostatic latent image on each of the photoconductive drums 1 by selective irradiation of light. Each of the electrostatic latent images is developed by the developing unit 3. Therefore, a toner image corresponding to the electrostatic latent image is formed on the surface of each of the photoconductive drums 1.

Each of the toner images is primarily transferred to the intermediate transfer belt 11 by each of the primary transfer rollers 16. The respective toner images are sequentially superimposed on the intermediate transfer belt 11 according to the movement of the intermediate transfer belt 11 without a color shift, and the superimposed toner image is transmitted to the secondary transfer unit 28.

The sheet S is supplied from the registration roller 24 to the secondary transfer unit 28. The toner image that reaches the secondary transfer unit 28 is secondarily transferred to the sheet S. The secondarily transferred toner image is fixed to the sheet S by the fixing unit 29. As a result, an image is formed on the sheet S.

Next, an opening and closing operation of the side cover unit 108 will be described with reference to FIGS. 10 to 14. FIGS. 10 to 14 are diagrams illustrating the opening and closing operation of the side cover unit 108 in the image forming apparatus 100 according to the embodiment.

FIGS. 10 to 14 illustrate only members on the +Z side among the members disposed on opposite sides in the Z direction. Accordingly, hereinafter, operations of the members on the +Z side will be described. However, even on the −Z side (not illustrated), the same operations are also embodied by the corresponding members.

Figure 10:
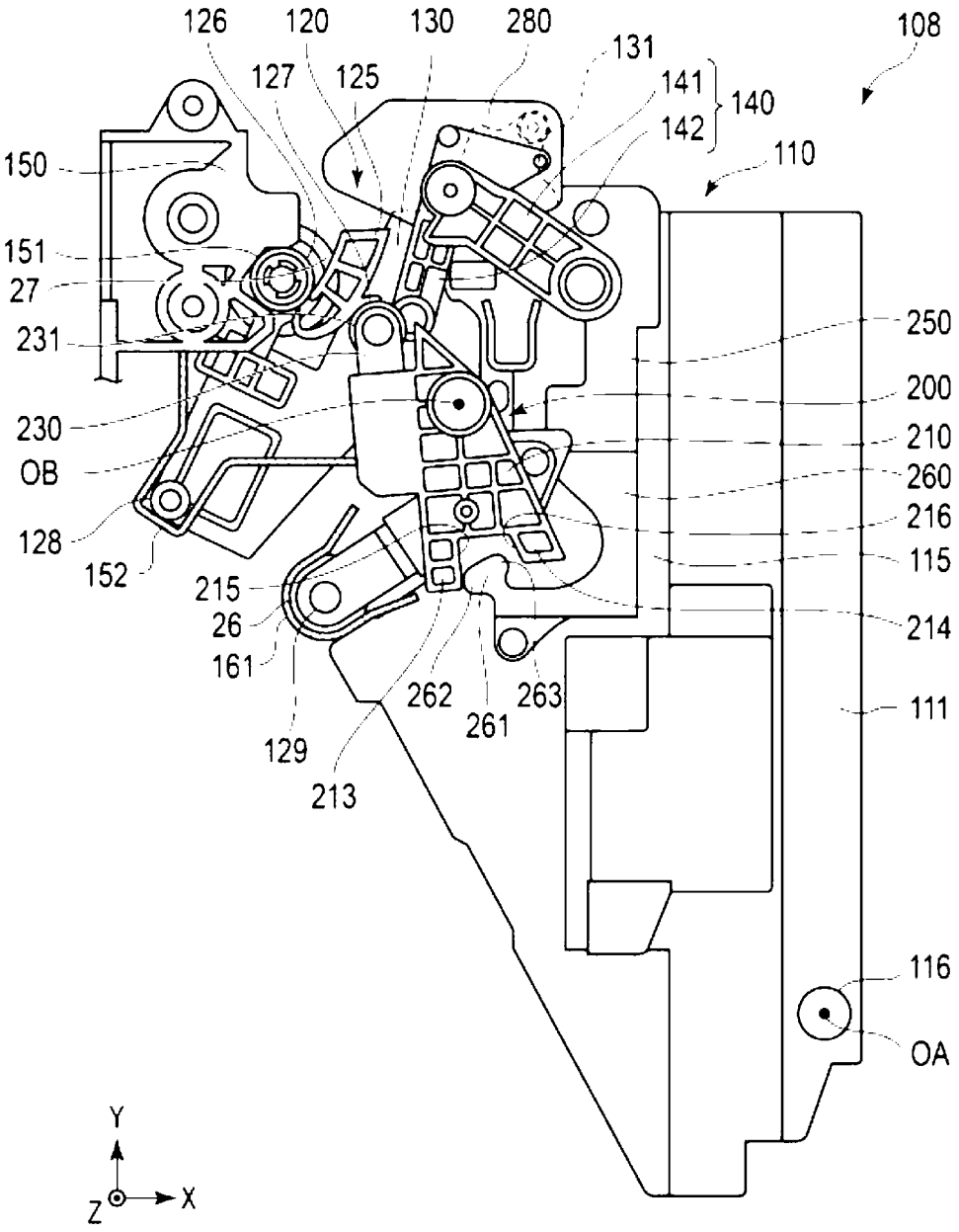
FIG. 10 is a diagram illustrating the side cover unit in a closed state.

FIG. 10 is a diagram illustrating the side cover unit 108 in a closed state. In this state, the engagement shaft 128 engages with the second engagement groove 152 of the engagement member 150. The bearing 129 of the second roller 26 engages with the engagement groove 161 of the registration roller support unit 160. The transfer roller unit 120 is pressurized by the pressurization mechanism 200. As a result, the bearing 126 of the secondary transfer roller 27 engages with the first engagement groove 151 of the engagement member 150.

Specifically, the pressurization force applying portion 262 of the protrusion 261 of the engagement portion 260 presses the pressurization force receiving portion 215 of the first extension portion 213 of the lever unit 210 in the −X direction. Therefore, the lever unit 210 is positioned at the first position. The pressurization roller 231 of the pressurization unit 230 engages with the pressurization unit abutting portion 127 from below. In addition, the pressurization spring 235 (refer to FIG. 8) of the pressurization unit 230 is compressed. As a result, the pressurization unit 230 pressurizes the pressurization unit abutting portion 127 from above. As a result, the bearing 126 of the secondary transfer roller 27 is pressed against the first engagement groove 151 of the engagement member 150.

By a user operating an operation unit such as a knob (not illustrated), the side cover unit 108 can be further opened from the closed state. For example, when jamming occurs in a part of the conveying unit 105, the side cover unit 108 is opened to remove the jammed sheet S.

At this time, the cover unit main body 110 in the side cover unit 108 rotates clockwise around the opening and closing shaft OA. The engagement portion 260 is fixed to opposite side surface portions of the cover unit main body 110. Therefore, the engagement portion 260 rotates clockwise around the opening and closing shaft OA as in the cover unit main body 110.

Figure 11:
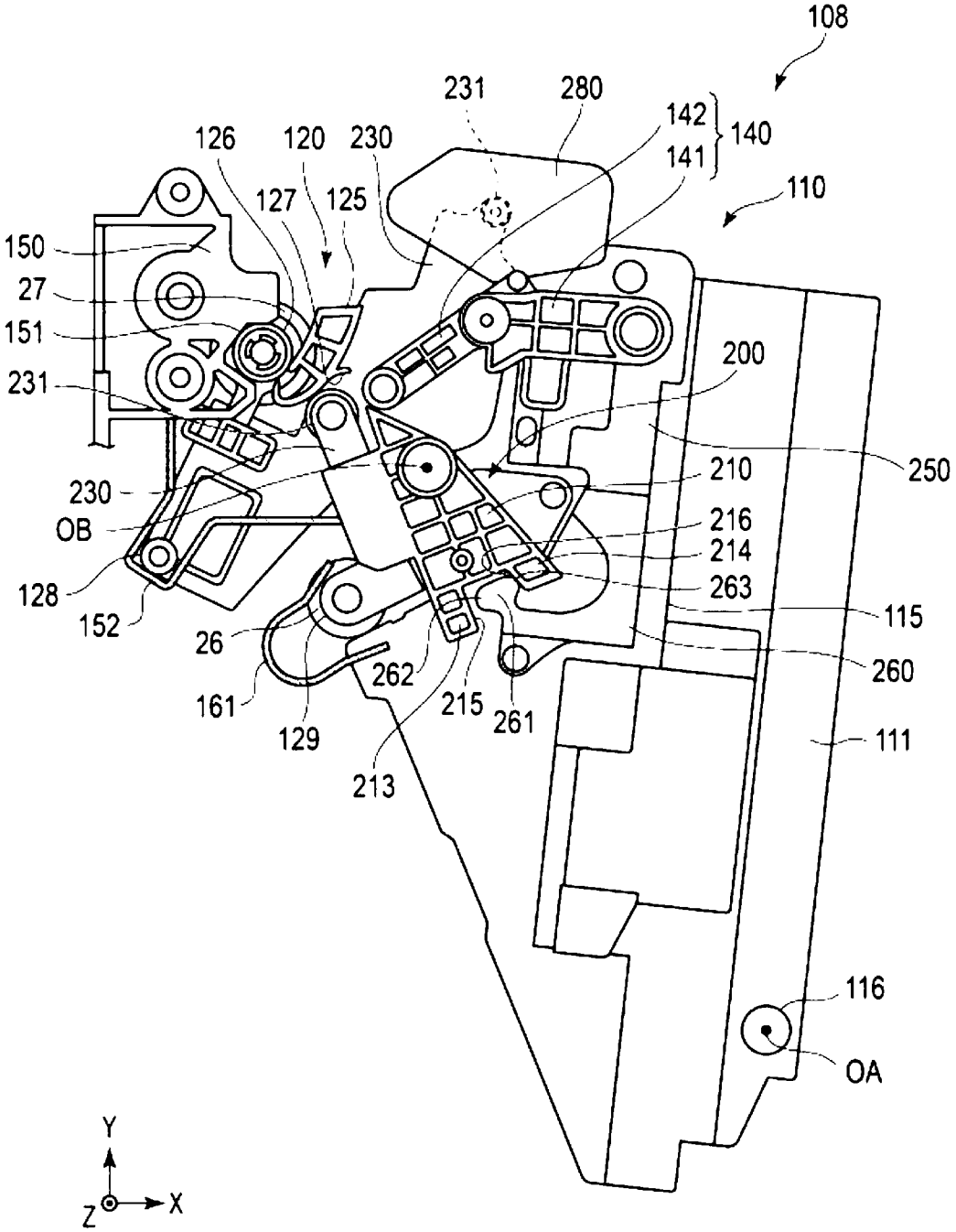
FIG. 11 is a diagram illustrating the side cover unit in a slightly opened state from the closed state illustrated in FIG. 10.

FIG. 11 is a diagram illustrating the side cover unit 108 in a slightly opened state from the closed state illustrated in FIG. 10. In the closed state, the pressurization force applying portion 262 of the protrusion 261 of the engagement portion 260 abuts against the pressurization force receiving portion 215 of the first extension portion 213 of the lever unit 210. In addition, the depressurization force applying portion 263 of the protrusion 261 is distant from the depressurization force receiving portion 216 of the second extension portion 214 of the lever unit 210.

As the side cover unit 108 opens, the protrusion 261 moves in the +X direction. While the pressurization spring 235 (refer to FIG. 8) of the pressurization unit 230 is compressed, contact between the pressurization force applying portion 262 of the protrusion 261 and the first extension portion 213 of the lever unit 210 is maintained due to a restoring force of the pressurization spring 235.

In addition, as the side cover unit 108 opens, the depressurization force applying portion 263 of the protrusion 261 approaches the depressurization force receiving portion 216 of the second extension portion 214 of the lever unit 210 and subsequently abuts against the depressurization force receiving portion 216. FIG. 11 illustrates a state where the depressurization force applying portion 263 of the protrusion 261 just abuts against the depressurization force receiving portion 216.

In this state, the engagement shaft 128 engages with the second engagement groove 152 of the engagement member 150. The bearing 129 of the second roller 26 disengages from the engagement groove 161 of the registration roller support unit 160. That is, the engagement between the bearing 129 and the registration roller support unit 160 is released. The pressurization roller 231 is separated from the pressurization unit abutting portion 127 but abuts against the bearing holder 125. Therefore, the pressurization of the transfer roller unit 120 by the pressurization mechanism 200 is still maintained. As a result, the bearing 126 of the secondary transfer roller 27 engages with the first engagement groove 151 of the engagement member 150. Therefore, an angle between the first link 141 and the second link 142 in the link mechanism 140 increases. The cover unit main body 110 is tilted at an angle different from that of the transfer roller unit 120.

When the side cover unit 108 is further opened from the state illustrated in FIG. 11, the engagement portion 260 rotates clockwise around the opening and closing shaft OA, and the depressurization force applying portion 263 of the protrusion 261 presses the depressurization force receiving portion 216 of the second extension portion 214 of the lever unit 210. As a result, the lever unit 210 rotates counterclockwise around the rotation shaft OB. As a result, the lever unit 210 is moved to the second position.

Figure 12:
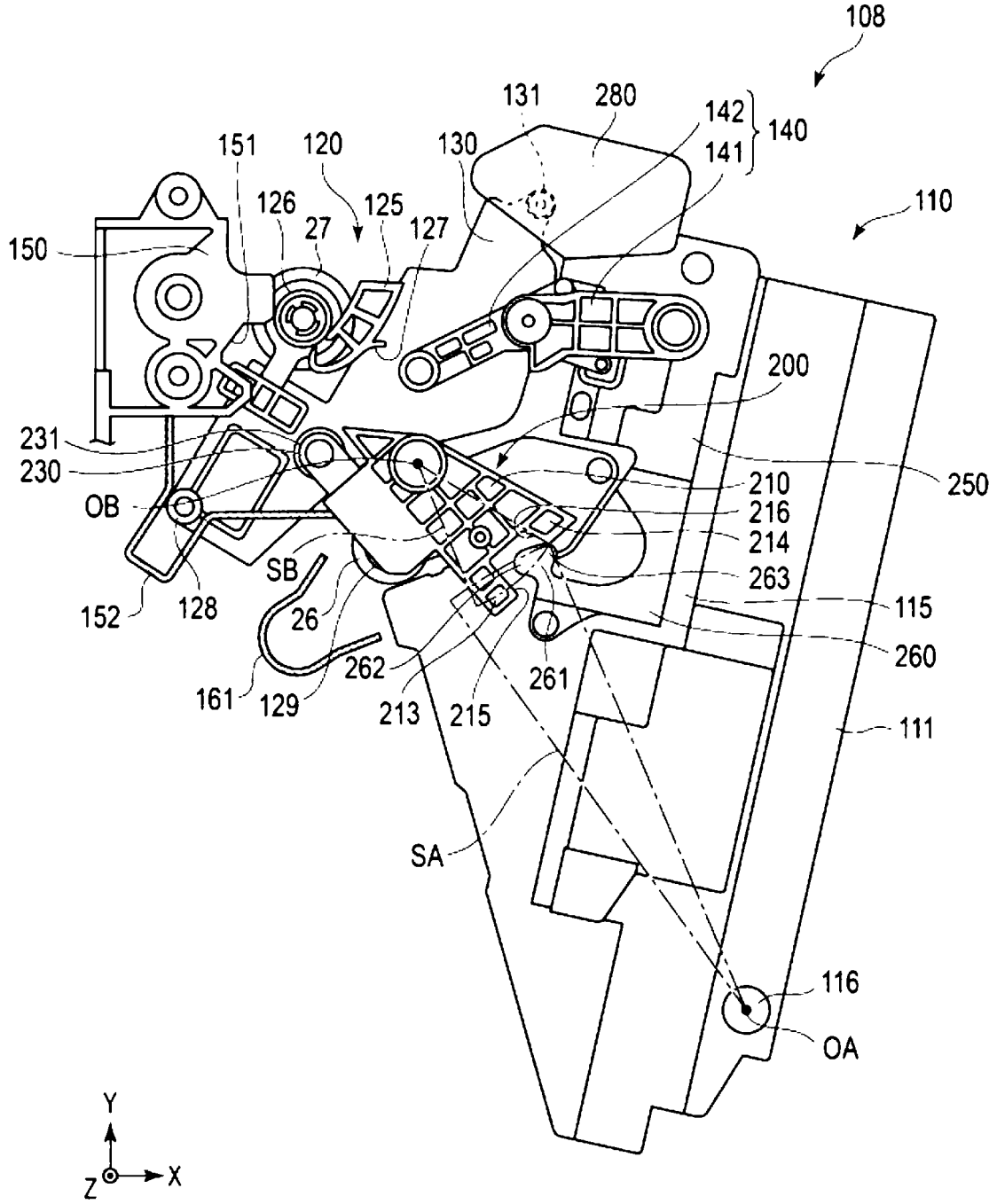
FIG. 12 is a diagram illustrating the side cover unit in a further opened state from the state illustrated in FIG. 11.

When the side cover unit 108 is further opened, before the lever unit 210 reaches the second position, the depressurization force applying portion 263 of the protrusion 261 disengages from the depressurization force receiving portion 216 of the lever unit 210. In other words, the protrusion 261 disengages from the lever unit 210 when the lever unit 210 is positioned at the third position between the first position and the second position. FIG. 12 is a diagram illustrating the side cover unit 108 in a further opened state from the state illustrated in FIG. 11, in which a state where the protrusion 261 just disengages from the lever unit 210 is illustrated.

Here, when the protrusion 261 disengages from the lever unit 210, the protrusion 261 may be separated from the space through which the lever unit 210 is capable of passing. That is, after the separation of the protrusion 261, the protrusion 261 is not present in the space through which the lever unit 210 is capable of passing.

When the side cover unit 108 is rapidly opened, the lever unit 210 may rotate vigorously. Even in this case, the lever unit 210 does not abut against the protrusion 261 while lever unit 210 moves from the third position to the second position. Accordingly, operation noise generated by the operation of opening the side cover unit 108 can be reduced.

In addition, the recess portion 265 of the engagement portion 260 provides a space for preventing interference with the lever unit 210 when the lever unit 210 is positioned at the third position.

In other words, the protrusion 261 is distant from the lever unit 210 as the side cover unit 108 opens. The protrusion 261 disengages from the lever unit 210 when the lever unit 210 is positioned at the third position.

From another viewpoint, a space through which the lever unit 210 passes partially overlaps a space through which the protrusion 261 passes in a region between the first position and the third position. However, a space through which the lever unit 210 passes does not overlap a space through which the protrusion 261 passes in a region between the third position and the second position.

In addition, from another viewpoint, on the XY plane, a fan-shaped portion SB that is formed by the rotation shaft OB and an orbit of a lower end of the depressurization force receiving portion 216 and a fan-shaped portion SA that is formed by the opening and closing shaft OA and an orbit of an upper end of the depressurization force applying portion 263 partially overlap each other in a region between the first position and the third position. Here, the lower end of the depressurization force receiving portion 216 is the farthest point of the depressurization force receiving portion 216 farthest from the rotation shaft OB, and the upper end of the depressurization force applying portion 263 is the farthest point of the depressurization force applying portion 263 farthest from the opening and closing shaft OA. In FIG. 12, for convenience of description, the fan-shaped portion SB and the fan-shaped portion SA are illustrated to correspond to the movable range of the lever unit 210 between the first position and the third position. As the side cover unit 108 opens, the protrusion 261 is distant from the lever unit 210. Although not illustrated in the drawing, the fan-shaped portion SB and the fan-shaped portion SA do not overlap each other in a region between the third position and the second position.

In the state of FIG. 12, the pressurization roller 231 is distant from the bearing holder 125. That is, the pressurization of the transfer roller unit 120 by the pressurization mechanism 200 is released. As a result, the bearing 126 of the secondary transfer roller 27 disengages from the first engagement groove 151 of the engagement member 150. In addition, the engagement shaft 128 floats from the second engagement groove 152 of the engagement member 150. That is, the engagement between the engagement shaft 128 and the engagement member 150 is released.

Figure 13:
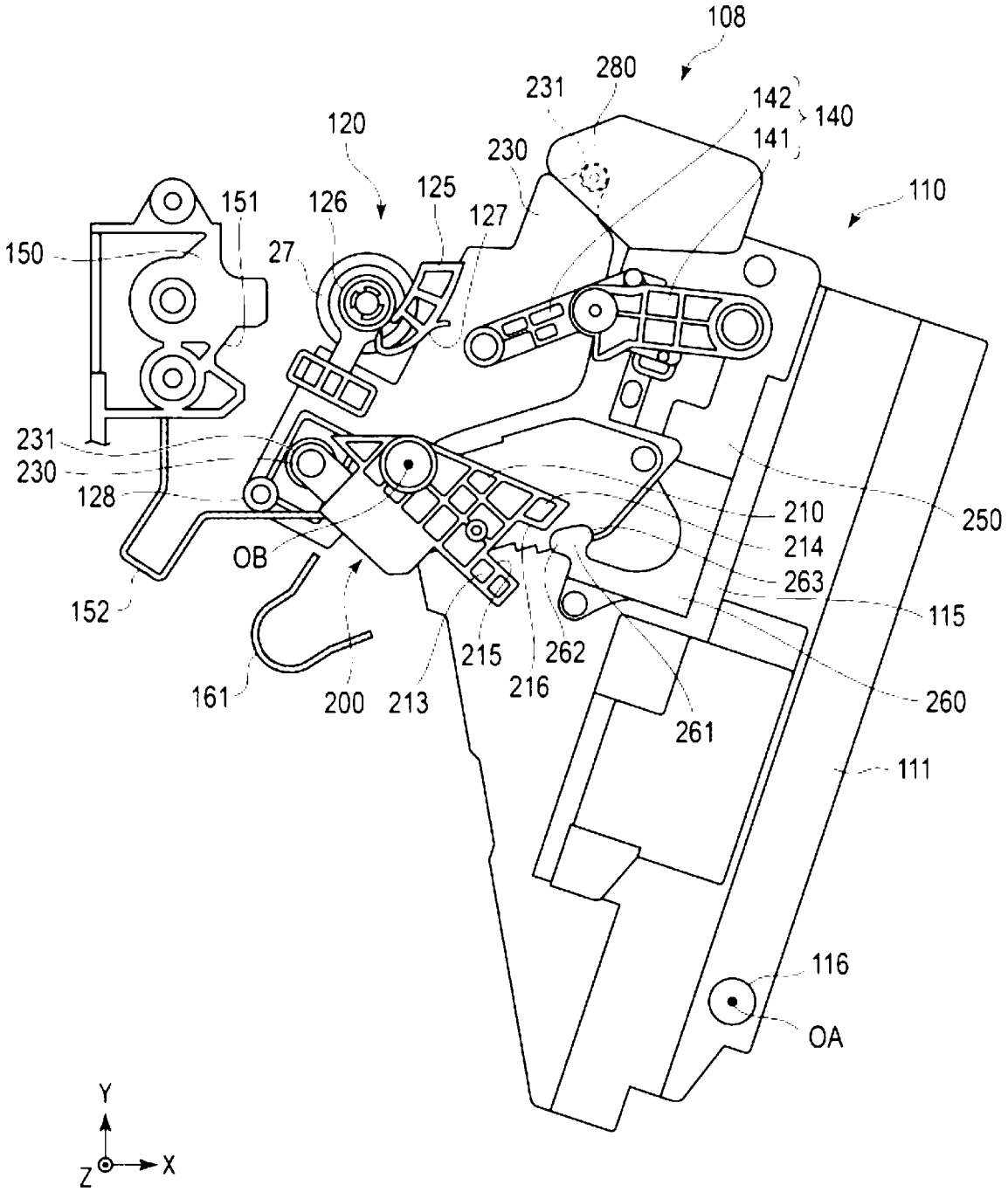
FIG. 13 is a diagram illustrating a lever unit in a state where the lever unit abuts against a rotation stopper.

Next, the lever unit 210 continuously rotates counterclockwise due to inertia, abuts against the rotation stopper 46 (refer to FIGS. 4 and 5) and is stopped. FIG. 13 is a diagram illustrating a lever unit 210 in a state where the lever unit 210 abuts against the rotation stopper 46. Due to mass balance around the rotation shaft OB, the pressurization mechanism 200 is maintained in a posture where the lever unit 210 is substantially horizontal as illustrated in the diagram. Specifically, in the pressurization mechanism 200, the mass of the pressurization unit 230 is more than that of the lever unit 210. Therefore, the pressurization mechanism 200 is maintained in a posture where the pressurization unit 230 is positioned on a lower side.

In this state, the protrusion 261 of the engagement portion 260 is distant from the lever unit 210. In addition, the engagement shaft 128 is positioned above the support unit 153 of the engagement member 150 and supports the transfer roller unit 120.

Next, the cover unit main body 110 is rotated clockwise to the maximum. As a result, the side cover unit 108 is in an opened state. While the cover unit main body 110 is rotated to the maximum, due to mass balance, the transfer roller unit 120 moves to a position where the transfer roller unit 120 is held on the transfer roller unit holding unit 115 as in the closed state of the side cover unit 108. Therefore, an opening angle between the first link 141 and the second link 142 in the link mechanism. 140 is the same as that in the closed state.

In the opened state of the side cover unit 108, the transfer roller unit 120 is maintained at a predetermined position of the transfer roller unit holding unit 115. As a result, the secondary transfer roller 27 is distant from the intermediate transfer belt 11 (refer to FIG. 1). The first conveyance guide portion 122 and the second conveyance guide portion 123 in the transfer roller unit 120 and the conveyance guide portion 114 in the cover unit main body 110 are distant from the conveyance guide portion 43 on the apparatus main body 40 side (refer to FIG. 2). As a result, the conveyance paths 31 and 32 of the conveying unit 105 are opened. Therefore, the conveyance paths 31 and 32 of the conveying unit 105 can remove the jammed sheet S.

Hereinabove, the operation of opening the side cover unit 108 from the closed state was described. By reversing the above-described operation, the side cover unit 108 is closed from the opened state.

Figure 14:
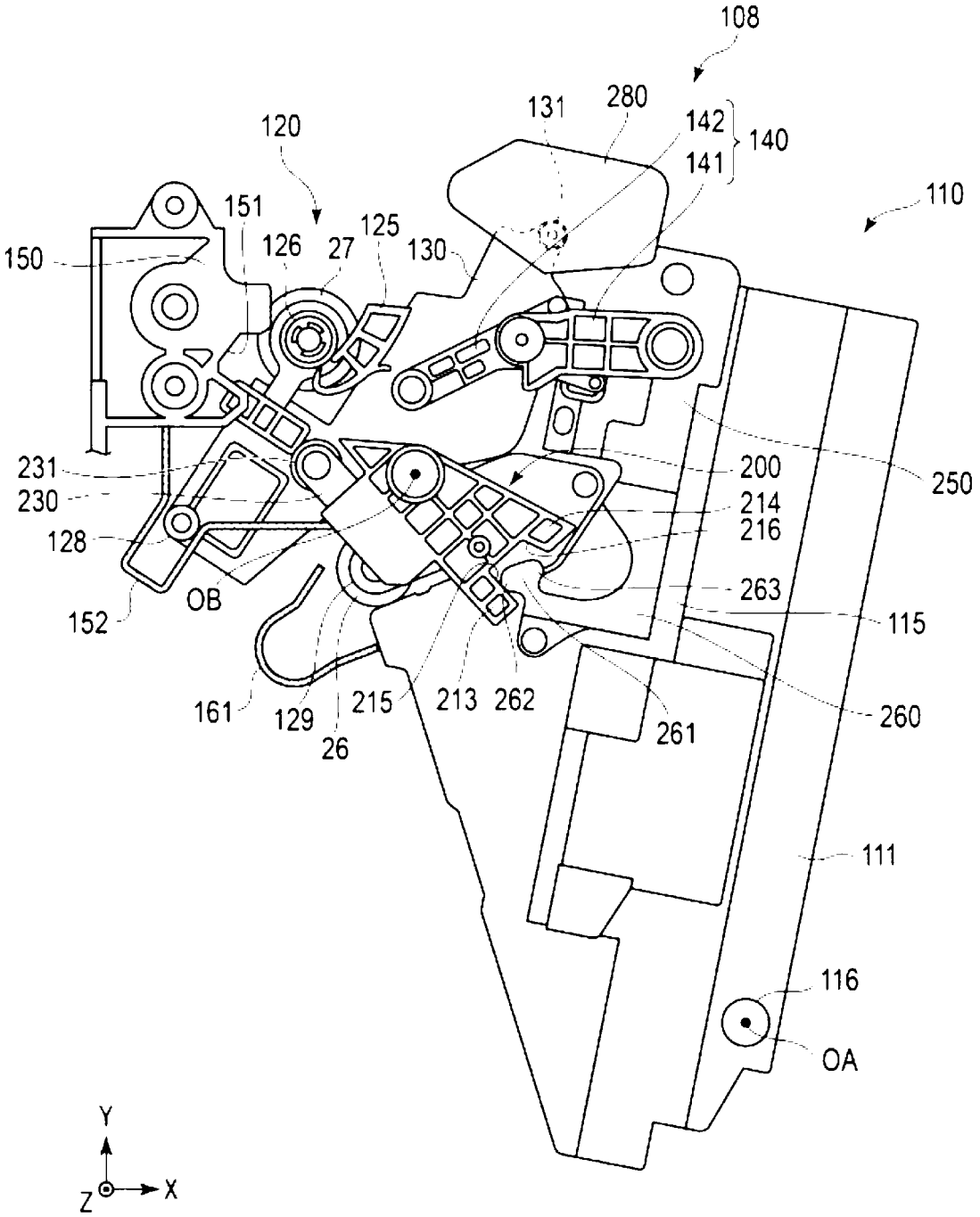
FIG. 14 is a diagram illustrating the side cover unit in a state where a pressurization force applying portion of a protrusion abuts against a pressurization force receiving portion of the lever unit while the side cover unit is being closed from an opened state.

FIG. 14 illustrates a state in which the side cover unit 108 is being closed from the opened state. In the opened state, the pressurization mechanism 200 is positioned at the second position and maintained in a posture illustrated in FIG.

13. When the side cover unit 108 is closed, the cover unit main body 110 rotates counterclockwise around the opening and closing shaft OA. As in the cover unit main body 110, the engagement portion 260 rotates counterclockwise around the opening and closing shaft OA.

As the side cover unit 108 closes, the protrusion 261 of the engagement portion 260 approaches the lever unit 210 and enters a space between the first extension portion 213 and the second extension portion 214. When the side cover unit 108 is further closed, the pressurization force applying portion 262 of the protrusion 261 of the engagement portion 260 abuts against the pressurization force receiving portion 215 of the first extension portion 213 of the lever unit 210. FIG. 14 illustrates a state where the pressurization force applying portion 262 of the protrusion 261 just abuts against the pressurization force receiving portion 215.

Next, when the side cover unit 108 is further closed, the pressurization force applying portion 262 of the protrusion 261 is pressed against the pressurization force receiving portion 215 of the first extension portion 213 in the −X direction. As a result, the lever unit 210 rotates clockwise around the rotation shaft OB. Next, the lever unit 210 is moved to the first position.

Further, while the lever unit 210 moves to the first position, the pressurization roller 231 of the pressurization unit 230 engages with the pressurization unit abutting portion 127 of the bearing holder 125. In addition, by the pressurization spring 235 (refer to FIG. 8) of the pressurization unit 230 being compressed, the pressurization unit 230 pressurizes the pressurization unit abutting portion 127 upward. As a result, the bearing 126 of the secondary transfer roller 27 is pressed against the first engagement groove 151 of the engagement member 150. That is, the bearing 126 engages with the engagement member 150. In addition, the engagement shaft 128 engages with the engagement member 150.

When the side cover unit 108 is completely closed, the side cover unit 108 enters a state illustrated in FIG. 10, and the secondary transfer roller 27 of the transfer roller unit 120 is pressed against the intermediate transfer belt 11 at a position of the support roller 13. The other details are as described above.

As described above, in the image forming apparatus 100 according to the embodiment, while the side cover unit 108 is closed, the engagement portion 260 provided in the side cover unit 108 activates the pressurization mechanism 200. Specifically, the protrusion 261 of the engagement portion 260 presses the first extension portion 213 of the lever unit 210 of the pressurization mechanism 200. As a result, the lever unit 210 rotates, the pressurization unit 230 presses the transfer roller unit 120, and the transfer roller unit 120 engages with the engagement member 150. As a result, the secondary transfer roller 27 is pressed against the intermediate transfer belt 11.

Conversely, while the side cover unit 108 is opened, the protrusion 261 of the engagement portion 260 presses the second extension portion 214 of the lever unit 210 of the pressurization mechanism 200. As a result, the lever unit 210 rotates, and the pressurization of the transfer roller unit 120 by the pressurization unit 230 is released. In addition, when the lever unit 210 reaches the third position, the protrusion 261 of the engagement portion 260 disengages from the lever unit 210 of the pressurization mechanism 200 to be separated from a space through which the lever unit 210 is capable of passing. As a result, even when the side cover unit 108 is rapidly opened such that the lever unit 210 rotates vigorously, the lever unit 210 does not collide with the protrusion 261 of the engagement portion 260. Accordingly, operation noise generated by the operation of opening the side cover unit 108 can be reduced.

Thereafter, the transfer roller unit 120 operates together with the cover unit main body 110, and the secondary transfer roller 27 is distant from the intermediate transfer belt 11. As a result, the conveyance path is opened.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image carrier;

an image forming component configured to form an image on the image carrier;

a transfer component comprising a transfer roller configured to transfer the image formed on the image carrier to a sheet;

an apparatus main body accommodating the image carrier and the image forming component, the apparatus main body having a cover;

a holding mechanism supported by the cover, configured to hold the transfer component in the apparatus main body;

a lever supported in the apparatus main body rotatably between a first position and a second position, configured to pressurize the transfer component to press the transfer roller against the image carrier when the lever is at the first position; and an engagement portion supported by the cover, configured to engage with the lever to move the lever to the first position while the cover is closed relative to the apparatus main body, to engage with the lever to move the lever to the second position while the cover is opened relative to the apparatus main body, and to disengage from the lever to be separated from a space through which the lever is capable of passing when the lever is positioned at a third position between the first position and the second position.

2. The image forming apparatus according to claim 1, wherein the lever comprises a first extension portion and a second extension portion that extend together in a radial direction of rotation of the lever and are distant from each other in an arc direction of rotation of the lever, and the engagement portion comprises a protrusion that enters a space between the first extension portion and the second extension portion when the engagement portion approaches and engages with the lever.

3. The image forming apparatus according to claim 2, wherein the first extension portion comprises a pressurization force receiving portion that receives a pressurization force to move the lever to the first position, the second extension portion comprises a depressurization force receiving portion that receives a depressurization force to move the lever to the second position, the pressurization force receiving portion and the depressurization force receiving portion face each other, the protrusion comprises a pressurization force applying portion that abuts against the pressurization force receiving portion and a depressurization force applying portion that abuts against the depressurization force receiving portion, and the pressurization force applying portion and the depressurization force applying portion are positioned opposite to each other in the protrusion.

4. The image forming apparatus according to claim 3, wherein the first extension portion is positioned inside of the second extension portion, and the pressurization force applying portion is positioned inside of the depressurization force applying portion.

5. The image forming apparatus according to claim 3, wherein a space through which the lever passes partially overlaps a space through which the protrusion passes in a region between the first position and the third position.

6. The image forming apparatus according to claim 5, wherein an opening and closing shaft of the cover and a rotation shaft of the lever are parallel to each other, and on a plane perpendicular to the opening and closing shaft and the rotation shaft, a fan-shaped portion that is formed by the rotation shaft and an orbit of a farthest point of the depressurization force receiving portion farthest from the rotation shaft and a fan-shaped portion that is formed by the opening and closing shaft and an orbit of a farthest point of the depressurization force applying portion farthest from the opening and closing shaft partially overlap each other in a region between the first position and the third position.

7. The image forming apparatus according to claim 1, wherein the cover opens and closes a conveyance path of the sheet in the apparatus main body.

8. The image forming apparatus according to claim 1, wherein the image carrier is an intermediate transfer belt, and the transfer roller is a secondary transfer roller.

9. An image forming apparatus, comprising:

an image carrier;

an image forming component configured to form an image on the image carrier;

a transfer component comprising a transfer roller configured to transfer the image formed on the image carrier to a sheet;

an apparatus main body accommodating the image carrier and the image forming component, the apparatus main body having a cover;

a holding mechanism supported by the cover, configured to hold the transfer component in the apparatus main body;

a lever supported in the apparatus main body rotatably between a first position and a second position, having a first extension portion and a second extension portion that extend together in a radial direction of rotation of the lever and are distant from each other in an arc direction of rotation of the lever, configured to pressurize the transfer component to press the transfer roller against the image carrier when the lever is at the first position; and an engagement portion supported by the cover, having a protrusion that is configured to engage with the first extension portion to move the lever to the first position while the cover is closed relative to the apparatus main body, to engage with the second extension portion to move the lever to the second position while the cover is opened relative to the apparatus main body, to move away from the lever as the cover opens relative to the apparatus main body, and to disengage from the lever when the lever is positioned at a third position between the first position and the second position.

10. The image forming apparatus according to claim 9, wherein the first extension portion comprises a pressurization force receiving portion that receives a pressurization force to move the lever to the first position, the second extension portion comprises a depressurization force receiving portion that receives a depressurization force to move the lever to the second position, the pressurization force receiving portion and the depressurization force receiving portion face each other, the protrusion comprises a pressurization force applying portion that abuts against the pressurization force receiving portion and a depressurization force applying portion that abuts against the depressurization force receiving portion, and the pressurization force applying portion and the depressurization force applying portion are positioned opposite to each other in the protrusion.

11. The image forming apparatus according to claim 10, wherein the first extension portion is positioned inside of the second extension portion, and the pressurization force applying portion is positioned inside of the depressurization force applying portion.

12. The image forming apparatus according to claim 10, wherein a space through which the lever passes partially overlaps a space through which the protrusion passes in a region between the first position and the third position.

13. The image forming apparatus according to claim 12, wherein an opening and closing shaft of the cover and a rotation shaft of the lever are parallel to each other, and on a plane perpendicular to the opening and closing shaft and the rotation shaft, a fan-shaped portion that is formed by the rotation shaft and an orbit of a farthest point of the depressurization force receiving portion farthest from the rotation shaft and a fan-shaped portion that is formed by the opening and closing shaft and an orbit of a farthest point of the depressurization force applying portion farthest from the opening and closing shaft partially overlap each other in a region between the first position and the third position.

14. The image forming apparatus according to claim 9, wherein the cover opens and closes a conveyance path of the sheet in the apparatus main body.

15. The image forming apparatus according to claim 9, wherein the image carrier is an intermediate transfer belt, and the transfer roller is a secondary transfer roller.

16. An image forming apparatus, comprising:

an image carrier;

an image forming component configured to form an image on the image carrier;

a transfer component comprising a transfer roller configured to transfer the image formed on the image carrier to a sheet;

an apparatus main body accommodating the image carrier and the image forming component, the apparatus main body having a cover;

a holding mechanism supported by the cover, configured to hold the transfer component in the apparatus main body;

a lever supported in the apparatus main body rotatably between a first position and a second position, having a first extension portion and a second extension portion that extend together in a radial direction of rotation of the lever and are distant from each other in an arc direction of rotation of the lever, configured to pressurize the transfer component to press the transfer roller against the image carrier when the lever is at the first position; and an engagement portion supported by the cover, having a recess portion and a protrusion, the recess portion provides a space for preventing interference with the lever when the lever is positioned at a third position, the protrusion that is configured to engage with the first extension portion to move the lever to the first position while the cover is closed relative to the apparatus main body, to engage with the second extension portion to move the lever to the second position while the cover is opened relative to the apparatus main body, to move away from the lever as the cover opens relative to the apparatus main body, and to disengage from the lever when the lever is positioned at the third position between the first position and the second position.

17. The image forming apparatus according to claim 16, wherein a space through which the lever passes partially overlaps a space through which the protrusion passes in a region between the first position and the third position.

18. The image forming apparatus according to claim 17, wherein an opening and closing shaft of the cover and a rotation shaft of the lever are parallel to each other, and on a plane perpendicular to the opening and closing shaft and the rotation shaft, a fan-shaped portion that is formed by the rotation shaft and an orbit of a farthest point of the depressurization force receiving portion farthest from the rotation shaft and a fan-shaped portion that is formed by the opening and closing shaft and an orbit of a farthest point of the depressurization force applying portion farthest from the opening and closing shaft partially overlap each other in a region between the first position and the third position.

19. The image forming apparatus according to claim 16, wherein the cover opens and closes a conveyance path of the sheet in the apparatus main body.

20. The image forming apparatus according to claim 16, wherein the image carrier is an intermediate transfer belt, and the transfer roller is a secondary transfer roller.

* * * * *